US010732547B1

(12) United States Patent
Deguchi et al.

(10) Patent No.: US 10,732,547 B1
(45) Date of Patent: Aug. 4, 2020

(54) IMAGE FORMING APPARATUS

(71) Applicant: FUJI XEROX CO., LTD., Tokyo (JP)

(72) Inventors: Koji Deguchi, Kanagawa (JP); Tsutomu Komiyama, Kanagawa (JP); Hibiki Sasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/532,814

(22) Filed: Aug. 6, 2019

(30) Foreign Application Priority Data

Mar. 20, 2019 (JP) ..... 2019-053250

(51) Int. Cl.
*G03G 15/16* (2006.01)
*G03G 21/16* (2006.01)

(52) U.S. Cl.
CPC ..... *G03G 15/161* (2013.01); *G03G 21/168* (2013.01); *G03G 21/1633* (2013.01)

(58) Field of Classification Search
CPC . G03G 15/161; G03G 15/1633; G03G 15/168
See application file for complete search history.

(56) References Cited

U.S. PATENT DOCUMENTS

2011/0242199 A1 10/2011 Nishimura
2012/0099896 A1* 4/2012 Kamano ..... G03G 15/161 399/121
2013/0077992 A1 3/2013 Shirai et al.
2016/0266537 A1 9/2016 Iida

FOREIGN PATENT DOCUMENTS

JP 2011-208082 A 10/2011
JP 2013-68841 A 4/2013
JP 2016-170354 A 9/2016

* cited by examiner

*Primary Examiner* — David M. Gray
*Assistant Examiner* — Michael A Harrison
(74) *Attorney, Agent, or Firm* — Sughrue Mion, PLLC

(57) ABSTRACT

An image forming apparatus includes: an opening and closing unit that is openable and closable with respect to an apparatus main body; a transfer unit that is provided in the apparatus main body and transfers an image from an image holding unit to a recording medium at a transfer position; an attaching unit that attaches the transfer unit to the opening and closing unit so as to be movable between the transfer position and a temporary holding position when the opening and closing unit is opened and closed; and a rotating unit that is provided in the apparatus main body, has a cutout portion that rotates while being in contact with the attaching unit when the opening and closing unit is closed, and moves the transfer unit toward the transfer position.

12 Claims, 23 Drawing Sheets

IMAGE FORMING APPARATUS

CROSS-REFERENCE TO RELATED APPLICATIONS

This application is based on and claims priority under 35 USC 119 from Japanese Patent Application No. 2019-053250 filed Mar. 20, 2019.

BACKGROUND (i) Technical Field

The present disclosure relates to an image forming apparatus.

(ii) Related Art

In the related art, as an image forming apparatus, there is an apparatus in which a secondary transfer roll is mounted on a cover provided so as to be openable and closable with respect to an apparatus main body. In the image forming apparatus, when the cover is closed, it is necessary to position the secondary transfer roll at an appropriate transfer position, and thus there is a concern that an operation force when closing the cover becomes excessive. As a technique related to such an image forming apparatus, an apparatus disclosed in JP-A-2013-68841 (Patent Literature 1) has already been proposed.

JP-A-2013-68841 discloses a transfer assembly including a transfer roll for transferring a toner image on an image holding member to a recording medium at a transfer position and a positioning portion, and also discloses a positioning member for positioning the transfer roll by receiving a pressure from the positioning portion.

SUMMARY

Aspects of non-limiting embodiments of the present disclosure relate to improving operability when an opening and closing unit is closed, as compared with a case where a fixed cylindrical member is used to form a unit that comes into contact with an attaching unit, when an opening and closing unit is closed, and moves a transfer unit attached to the attaching unit from a temporary holding position to a transfer position.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: an opening and closing unit that is openable and closable with respect to an apparatus main body; a transfer unit that is provided in the apparatus main body and transfers an image from an image holding unit to a recording medium at a transfer position; an attaching unit that attaches the transfer unit to the opening and closing unit so as to be movable between the transfer position and a temporary holding position when the opening and closing unit is opened and closed; and a rotating unit that is provided in the apparatus main body, has a cutout portion that rotates while being in contact with the attaching unit when the opening and closing unit is closed, and moves the transfer unit toward the transfer position.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the disclosure will be described with reference to the drawings.

Exemplary Embodiment 1

Figure 1:
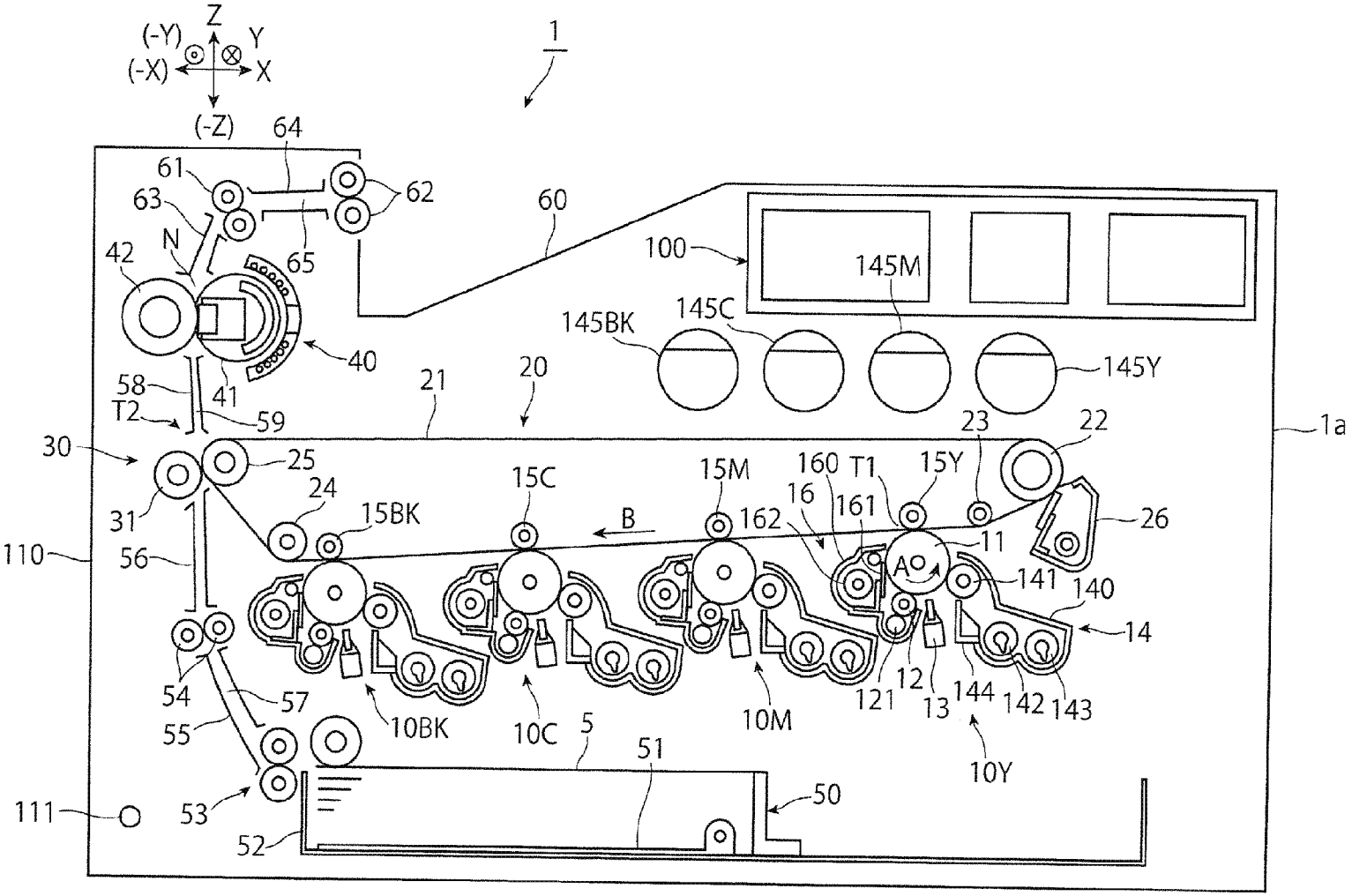
FIG. 1 is a schematic configuration diagram illustrating a color image forming apparatus as an image forming apparatus according to Exemplary Embodiment 1 of the disclosure.

FIG. 1 schematically illustrates an entire color image forming apparatus as an example of an image forming apparatus according to Exemplary Embodiment 1. In the drawings, an arrow X indicates a width direction along a horizontal direction, Y indicates a depth direction along the horizontal direction, and Z indicates a vertical direction, respectively.

Overall Configuration of Color Image Forming Apparatus

A color image forming apparatus 1 is configured, for example, as a color printer. As illustrated in FIG. 1, the color image forming apparatus 1 includes: imaging devices 10 as an example of plural image forming units for forming toner images developed with toner that configures a developer; an intermediate transfer device 20 as an example of an intermediate transfer unit for holding each of the toner images formed in each of the imaging devices 10 and finally transporting the toner images to a secondary transfer position T2 at which secondary transfer is performed on a recording paper 5 as an example of a recording medium; a paper feeding device 50 that accommodates and transports the required recording paper 5 to be supplied to the secondary transfer position T2 of the intermediate transfer device 20; and a fixing device 40 that fixes the toner image on the recording paper 5 that is secondarily transferred by the intermediate transfer device 20. A reference numeral 1*a* indicates an apparatus main body formed with a support structure member, an exterior cover, and the like.

The imaging device 10 is configured with four imaging devices 10V, 10M, 10C, and 10BK which respectively form toner images of four colors, such as yellow (Y), magenta (M), cyan (C), and black (BK) exclusively. The four imaging devices 10 (Y, M, C, and BK) are disposed in one row in a state of being inclined with respect to the horizontal direction X in an internal space of the apparatus main body 1*a*.

As illustrated in FIG. 1, each of the imaging devices 10 (V, M, C, and BK) includes a photosensitive drum 11 as an example of a rotating image holding unit, and each of the following devices is mainly disposed around the photosensitive drum 11. Examples of the main devices include: a charging device 12 that charges a peripheral surface (image holding surface) of the photosensitive drum 11 on which an image can be formed, to a required potential; an exposure device 13 as an example of an electrostatic latent image forming unit that forms an electrostatic latent image (for each color) having a potential difference by irradiating the charged peripheral surface of the photosensitive drum 11 with light based on information (signal) of the image; a developing device 14 as an example of a developing unit that develops and makes the toner images with the toner of the developer having colors (Y, M, C, and BK) that correspond to the electrostatic latent image; a primary transfer device 15 as an example of a primary transfer unit that transfers each of the toner images to the intermediate transfer device 20; and a drum cleaning device 16 as an example of a cleaning unit for removing and cleaning an adhering material, such as toner that remains and adheres to an image holding surface of the photosensitive drum 11 after the primary transfer.

The photosensitive drum 11 has the image holding surface having a photoconductive layer (photosensitive layer) made of a photosensitive material on the peripheral surface of a cylindrical or columnar base material to be grounded. The photosensitive drum 11 is supported so as to be rotated in a direction indicated by the arrow A as driving force is transmitted from a driving device (not illustrated).

The charging device 12 is configured of a contact type charging roll disposed in a state of being in contact with the photosensitive drum 11. The charging device 12 is supplied with a charging voltage. As the charging voltage, in a case where the developing device 14 performs reversal development, a voltage or a current having the same polarity as the charging polarity of the toner supplied from the developing device 14 is supplied. A cleaning roll 121 for cleaning the surface of the charging roll 12 is disposed in a state of being in contact with the rear surface side of the charging roll 12.

The exposure device 13 is configured with an LED print head or the like that irradiates the photosensitive drum 11 with light that corresponds to the image information by light emitting diodes (LED) that serve as plural light emitting elements arranged along the axial direction of the photosensitive drum 11 to form the electrostatic latent image. When it is time to form a latent image, information (signal) of an image input into the color image forming apparatus 1 by any means is transmitted to the exposure device 13. In addition, it is needless to say that, as the exposure device 13, a device that irradiates the charged peripheral surface of the photosensitive drum 11 with laser light configured corresponding to the information of the image input into the color image forming apparatus 1 to form an electrostatic latent image is used.

As illustrated in FIG. 1, any of the developing devices 14 (Y, M, C, and BK) has a configuration in which a developing roll 141 for holding and transporting the developer to a developing region that faces the photosensitive drum 11, stirring transport members 142 and 143, such as a screw auger, for transporting the developer so as to cause the developer pass through the developing roll 141 while stirring the developer, a layer thickness regulating member 144 for regulating the amount (layer thickness) of the developer held by the developing roll 141, and the like are disposed on the inside of a housing 140 in which an opening portion and an accommodation chamber of the developer are formed. A developing voltage is supplied to the developing device 14 from a power source device (not illustrated) between the developing roll 141 and the photosensitive drum 11. In addition, the developing roll 141 or the stirring transport members 142 and 143 rotate in a required direction as the driving force is transmitted from the driving device (not illustrated). Furthermore, as the developers (Y, M, C, and BK) of four colors, two-component developers containing non-magnetic toner and magnetic carrier are used.

In each of the developing devices 14 (Y, M, C, and BK), each of the toners of corresponding colors is replenished via a toner replenishing device (not illustrated) from each toner cartridge 145 (Y, M, C, and BK) of yellow (Y), magenta (M), cyan (C), and black (BK) that are disposed at a position above the intermediate transfer device 20.

The primary transfer device 15 is a contact type transfer device including a primary transfer roll which rotates while being in a contact with the peripheral surface of the photosensitive drum 11 via the intermediate transfer belt 21 at a primary transfer position T1, and to which a primary transfer voltage is supplied. As the primary transfer voltage, a DC voltage or current indicating a polarity opposite to the charge polarity of the toner is supplied from a high voltage source.

The drum cleaning device 16 is configured with a cleaning blade 161 that is disposed on the inside of a container-like main body 160 and removes and cleans the adhering material, such as residual toner, a sending member 162, such as a screw auger, for collecting the adhering material, such as toner removed by the cleaning blade 161 and transporting so as to feed the adhering material to a collecting system (not illustrated), and the like.

The intermediate transfer device 20 is disposed to be at a position above each of the imaging devices 10 (Y, M, C, and BK). The intermediate transfer device 20 is mainly configured with an intermediate transfer belt 21 as an example of the image holding unit that circulates and moves in the direction indicated by the arrow B while passing through the primary transfer position T1 between the photosensitive drum 11 and the primary transfer device 15 (primary transfer roll), plural belt support rolls 22 to 25 that hold the intermediate transfer belt 21 in a desired state from an inner periphery thereof and support the intermediate transfer belt 21 to be capable of circulating and moving, a secondary transfer device 30 that is disposed on an outer peripheral surface (image holding surface) side of the intermediate transfer belt 21 supported by the belt support roll 25 and secondarily transfers the toner image on the intermediate transfer belt 21 onto the recording paper 5, and a belt cleaning device 26 for removing and cleaning the adhering material, such as toner or paper dust remaining and adhering to the outer peripheral surface of the intermediate transfer belt 21 after passing through the secondary transfer device 30.

As the intermediate transfer belt 21, for example, an endless belt made of a material in which a resistance adjuster, such as carbon black, is dispersed in a synthetic resin, such as a polyimide resin or a polyamide resin, is used. In addition, the belt support roll 22 is configured as a drive roll, the belt support roll 23 is configured as a facing roll that holds a traveling position of the intermediate transfer belt 21, the belt support roll 24 is configured as a tension application roll, and the belt support roll 25 is configured as a secondary transfer backup roll.

Figure 2:
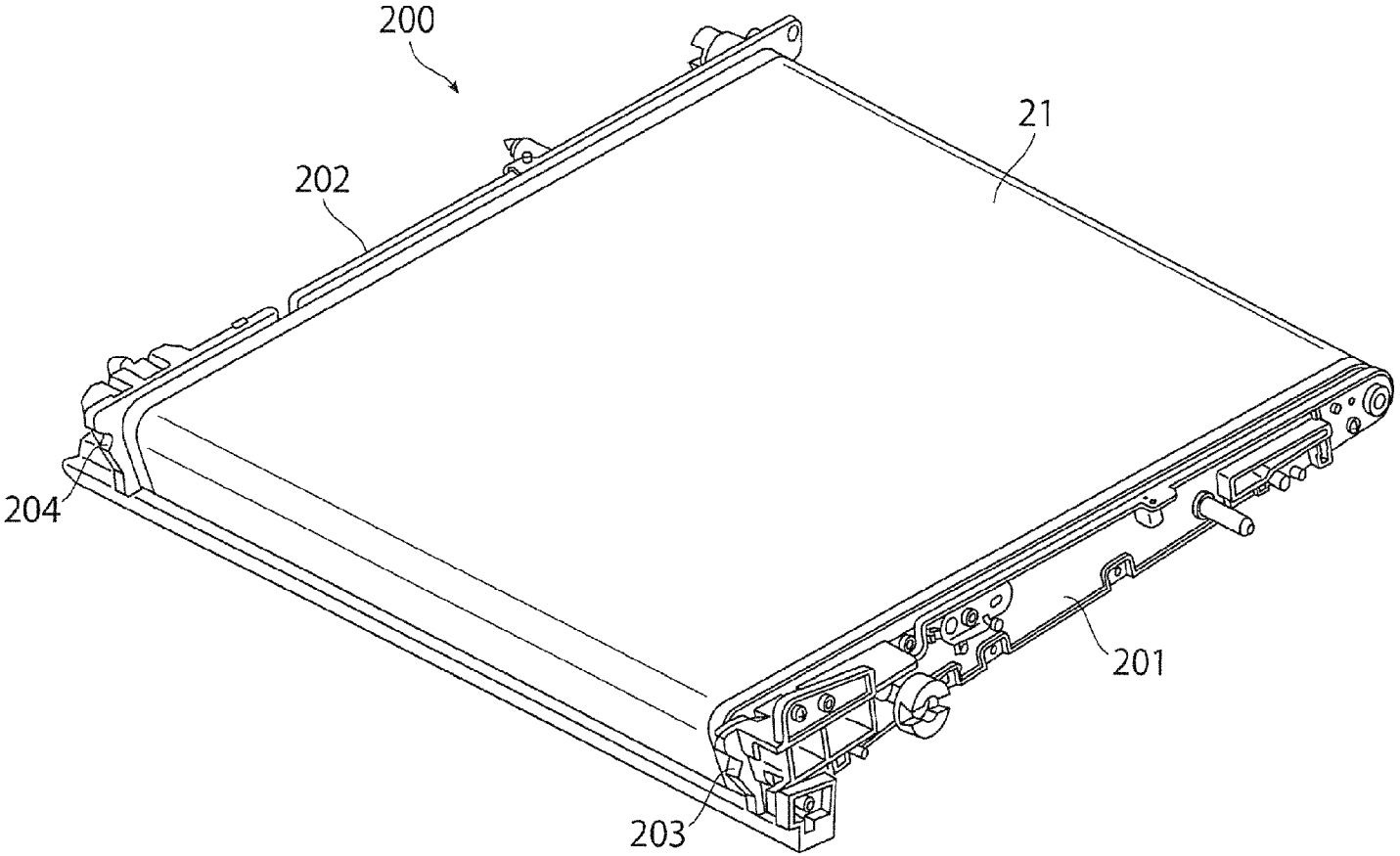
FIG. 2 is a perspective configuration view illustrating an intermediate transfer unit.

As illustrated in FIG. 2, the intermediate transfer device 20 of the color image forming apparatus 1 is integrally configured as the intermediate transfer unit 200 including the intermediate transfer belt 21, the plural belt support rolls 22 to 25, and the primary transfer devices 15 (Y, M, C, and BK). The intermediate transfer unit 200 is attachable to and detachable from the apparatus main body 1*a*.

The intermediate transfer unit 200 includes front and rear side frames 201 and 202 disposed at both end portions along the width direction intersecting a movement direction of the intermediate transfer belt 21. The belt support rolls 22 to 25 and the primary transfer devices 15 (Y, M, C, and BK) are rotatably supported by both side frames 201 and 202. In the front and rear side frames 201 and 202, in the end portion that corresponds to the belt support roll 25 functioning as a backup roll which is one end portion along the longitudinal direction, positioning recessed portions 203 and 204 for positioning the secondary transfer roll 31 of the secondary transfer device 30 are provided. The intermediate transfer unit 200 is mounted and fixed at a predetermined position of the apparatus main body 1*a* of the color image forming apparatus 1. As a result, the positioning recessed portions 203 and 204 are disposed in a state of being fixed to a required position on the apparatus main body 1*a* side of the color image forming apparatus 1, with the intermediate transfer unit 200.

As illustrated in FIG. 1, the secondary transfer device 30 includes the secondary transfer roll 31 that rotates at the secondary transfer position T2 which is an outer peripheral surface part of the intermediate transfer belt 21 supported by the belt support roll 25 in the intermediate transfer device 20. A DC voltage having a polarity opposite to or the same as the charging polarity of the toner is supplied to the secondary transfer roll 31 or the belt support roll 25 of the intermediate transfer device 20, as a secondary transfer voltage. In Exemplary Embodiment 1, the DC voltage having the same polarity as the charging polarity of the toner is applied to the belt support roll 25 of the intermediate transfer device 20 as a secondary transfer voltage. The secondary transfer roll 31 is connected (grounded) to the ground. In addition, the configuration of the secondary transfer device 30 will be described in detail later.

The fixing device 40 has a configuration in which a heating rotary body 41 in the form of a belt or a roll which is heated by a heating unit, such as electromagnetic induction heating or a heat source, such that a surface temperature is held at a predetermined temperature, and a pressurizing rotary body 42 in the form of a belt or a roll which rotates while being in contact with the heating rotary body 41 with a required pressure, are disposed. In the fixing device 40, a contact portion where the heating rotary body 41 and the pressurizing rotary body 42 are in contact with each other serves as a fixing processing unit N that performs required fixing processing (heating and pressurizing).

The paper feeding device 50 is disposed to be at a position below the imaging devices 10 (Y, M, C, and Bk). The paper feeding device 50 is mainly configured with a single (or plural) paper container(s) 52 for accommodating the recording papers 5 having a desired size and type in a state of being stacked on a stacking plate 51, and a feeding device 53 for feeding the recording papers 5 from the paper container 52 one by one. The paper container 52 is attached, for example, so as to be capable of being pulled out to the front face (a side surface that faces the user at the time of operation) side of the apparatus main body 1*a*.

Examples of the recording paper 5 include thin paper including plain paper or tracing paper used in an electrophotographic copying machine, a printer, and the like, or an OHP sheet made of a transparent film-like medium manufactured by a synthetic resin (PET or the like). In order to further improve the smoothness of the image surface after the fixing, the surface of the recording paper may be as smooth as possible, and for example, it is also possible to suitably use so-called thick paper or the like having a relatively large basis weight, such as coated paper obtained by coating the surface of plain paper with a resin or the like, or art paper for printing.

Between the paper feeding device 50 and the secondary transfer device 30, a paper feeding transporting path 57 configured with a single (or plural) paper transport roll pair(s) 54 or transporting guide members 55 and 56 for transporting the recording paper 5 fed from the paper feeding device 50 to the secondary transfer position T2, is provided. The paper transport roll pair 54 disposed at the position immediately before the secondary transfer position T2 in the paper feeding transporting path 57 is configured as, for example, a roll (resist roll) that adjusts the transport timing of the recording paper 5.

In addition, between the secondary transfer device 30 and the fixing device 40, a paper transporting path 59 configured with a transporting guide member 58 or the like for transporting the recording paper 5 fed from the secondary transfer device 30 to the fixing device 40, is provided.

On the downstream side of the fixing device 40, a discharging and transporting path 65 including a paper transport roll pair 61 and a paper output roll pair 62 or a transporting guide members 63 and 64 for outputting the recording paper 5 to which the toner image is fixed by the fixing device 40 to a paper output portion 60 disposed in the upper portion of the apparatus main body 1*a*, is provided.

In FIG. 1, a reference numeral 100 indicates a control device as an example of a controller for generally controlling the operation of the color age forming apparatus 1.

Basic Operation of Color Image Forming Apparatus

Hereinafter, a basic image forming operation by the color image forming apparatus 1 will be described.

Here, the image forming operation when forming a full color image configured by combining the toner images of four colors (Y, M, C, and BK) using the four imaging devices 10 (Y, M, C. and BK) will be described. In addition, the image forming operation when forming the image obtained by combining a single or plural toner images using any one imaging device 10 among the four imaging devices 10 (Y, M, C, and BK), is also basically the same.

When the color image forming apparatus 1 receives command information of the request of the image forming operation (printing), under the control of the control device 100, the four imaging devices 10 (Y, M, C, and BK), the intermediate transfer device 20, the secondary transfer device 30, the fixing device 40 and the like are initiated.

In addition, in each of the imaging devices 10 (Y, M, C, and BK), as illustrated in FIG. 1, first, each of the photosensitive drums 11 rotates in the direction indicated by the arrow A, and each of the charging devices 12 charges the surface of each of the photosensitive drums 11 to a required polarity (negative polarity in Exemplary Embodiment 1) and potential. Subsequently, the exposure devices 13 irradiate the charged surface of the photosensitive drum 11 with the light emitted based on the signal of the image obtained by converting the information of the image input into the color image forming apparatus 1 into each color component (Y, M, C, and BK), and respectively form the electrostatic latent images of each color component configured by a required potential difference on the surface.

Subsequently, each of the developing devices 14 (Y, M, C, and BK) performs development by respectively supplying the toners of corresponding colors (Y, M, C, and BK) charged to the required polarity (negative polarity) and by electrostatically adhering the toner, with respect to the electrostatic latent image of each color component formed on the photosensitive drum 11. By the development, the electrostatic latent images of each color component formed on each of the photosensitive drums 11 are visualized as toner images of tour colors (Y, M, C, and BK) that are respectively developed with the toners of the corresponding colors.

Subsequently, when the toner images of each color formed on the photosensitive drums 11 of each of the imaging devices 10 (Y, M, C, and BK) are transported to the primary transfer position T1, the primary transfer device 15 primarily transfers the toner images of each color in a state where the toner images sequentially overlap the intermediate transfer belt 21 that rotates in the direction indicated by the arrow B of the intermediate transfer device 20.

In addition, in each of the imaging devices 10 (Y, M, C, and BK) in which the primary transfer is completed, the drum cleaning device 16 removes the adhering material so as to scrape the adhering material, and the surface of the photosensitive drum 11 is cleaned. Accordingly, each of the imaging devices 10 (Y, M, C, and BK) is in a state where the next imaging operation is possible.

Subsequently, in the intermediate transfer device 20, the toner image primarily transferred by the rotation of the intermediate transfer belt 21 is held and transported to the secondary transfer position T2. Meanwhile, in the paper feeding device 50, the required recording paper 5 is sent to the paper feeding transporting path 57 in accordance with the imaging operation. In the paper feeding transporting path 57, the paper transport roll pair 54 as a registration roll sends and supplies the recording paper 5 to the secondary transfer position T2 in accordance with the transfer timing.

At the secondary transfer position T2, the secondary transfer roll 31 collectively and secondarily transfers the toner image on the intermediate transfer belt 21 onto the recording paper 5. In addition, in the intermediate transfer device 20 after the secondary transfer is completed, the belt cleaning device 26 removes and cleans the adhering material, such as toner remaining on the surface of the intermediate transfer belt 21 after the secondary transfer.

Subsequently, the recording paper 5 onto which the toner image is secondarily transferred is separated from the intermediate transfer belt 21 and the secondary transfer roll 31, and then transported to the fixing device 40 along the paper transporting path 59. In the fixing device 40, by introducing and passing the recording paper 5 after the secondary transfer to the fixing processing unit N between the heating rotary body 41 and the pressurizing rotary body 42, the necessary fixing processing (healing and pressurizing) is performed and the unfixed toner image is fixed to the recording paper 5. The recording paper 5 after the fixing is completed is output to the paper output portion 60 provided in the upper portion of the apparatus main body 1*a* by the paper output roll pair 62 through the discharging and transporting path 65.

By the above-described operation, a full color image formed by combining the toner images made of toner T (Y, M, C, and BK) of four colors is output.

Configuration of Secondary Transfer Device

As illustrated in FIG. 1, the secondary transfer device 30 includes the secondary transfer roll 31 as an example of the transfer unit that rotates at the secondary transfer position T2 which is the outer peripheral surface part of the intermediate transfer belt 21 as an example of the image holding unit supported by the belt support roll 25 in the intermediate transfer device 20.

Figure 3:
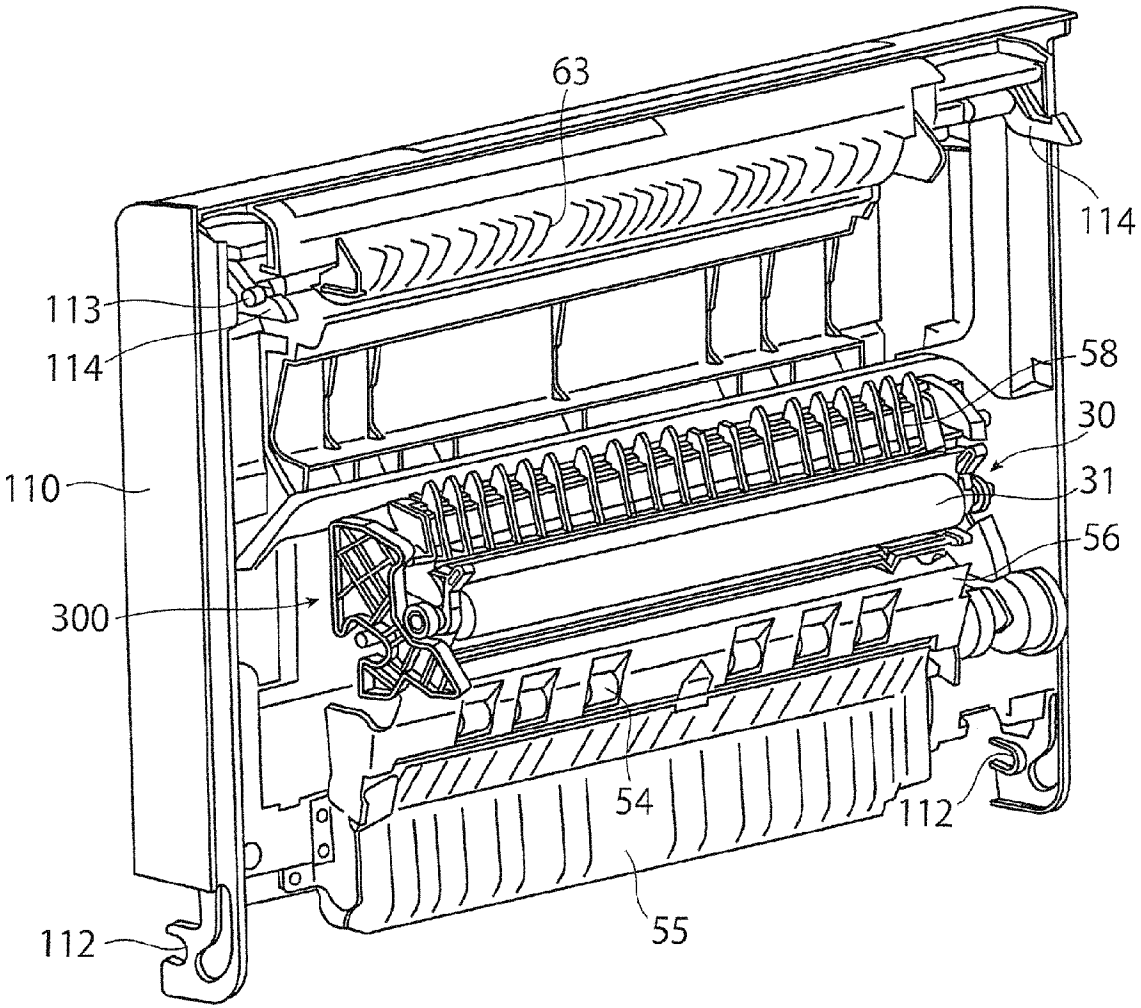
FIG. 3 is a perspective configuration view illustrating a side cover.
Figure 4:
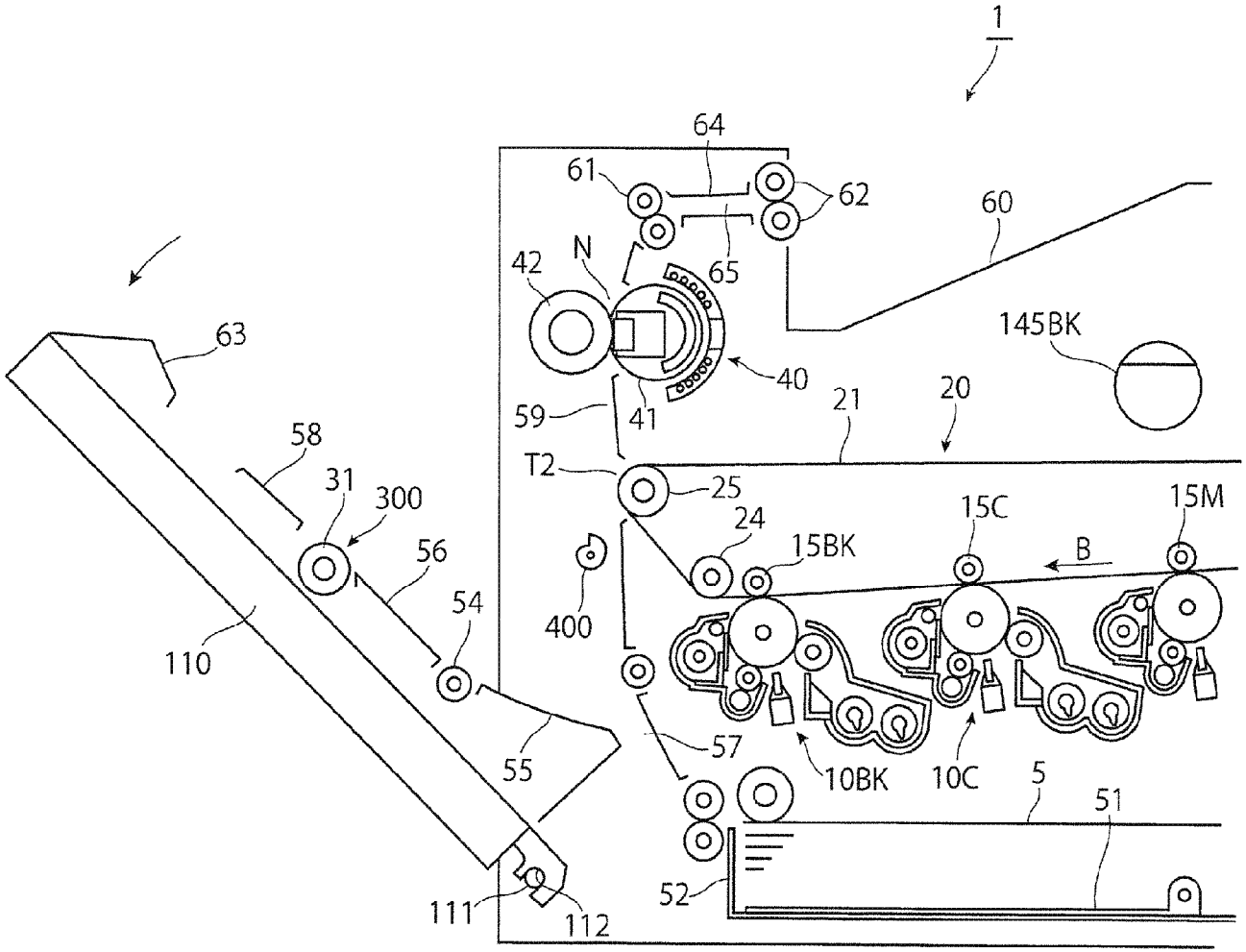
FIG. 4 is a front configuration view of a fixing device according to Exemplary Embodiment 1 of the disclosure.

In Exemplary Embodiment 1, as illustrated in FIG. 3, the secondary transfer device 30 configures a secondary transfer unit 300 as an example of an exchange unit configured to be attachable to and detachable from a side cover 110 as an example of an opening and closing unit of the apparatus main body 1*a*. As illustrated in FIG. 4, the side cover 110 is attached to the side surface of the apparatus main body 1*a* so as to be openable and closable around a fulcrum 111 provided in the lower portion of one side surface of the apparatus main body 1*a*.

As illustrated in FIGS. 3 and 4, in addition to the secondary transfer unit 300, the transporting guide members 55 and 56 that configure the paper feeding transporting path 57, one paper transport roll 54 of the paper transport roll pair 54, the transporting guide member 58 that configures the paper transporting path 59 provided in the secondary transfer unit 300, the transporting guide member 63 that configures a part of the discharging and transporting path 65, and the like are attached to the side cover 110. In the lower end portion of the side cover 110, a recessed cutout portion 112 for attaching the side cover 110 to the fulcrum 111 of the apparatus main body 1*a* to be openable and closable, is provided. In addition, in the upper end portion of the side cover 110, as illustrated in FIG. 3, a locking member 114 that is locked to a columnar locking portion 113 provided on the apparatus main body 1*a* side by operating an operation portion (not illustrated) when opening and closing the side cover 110, and is locked in a state where the side cover 110 is closed, is provided.

Figure 5:
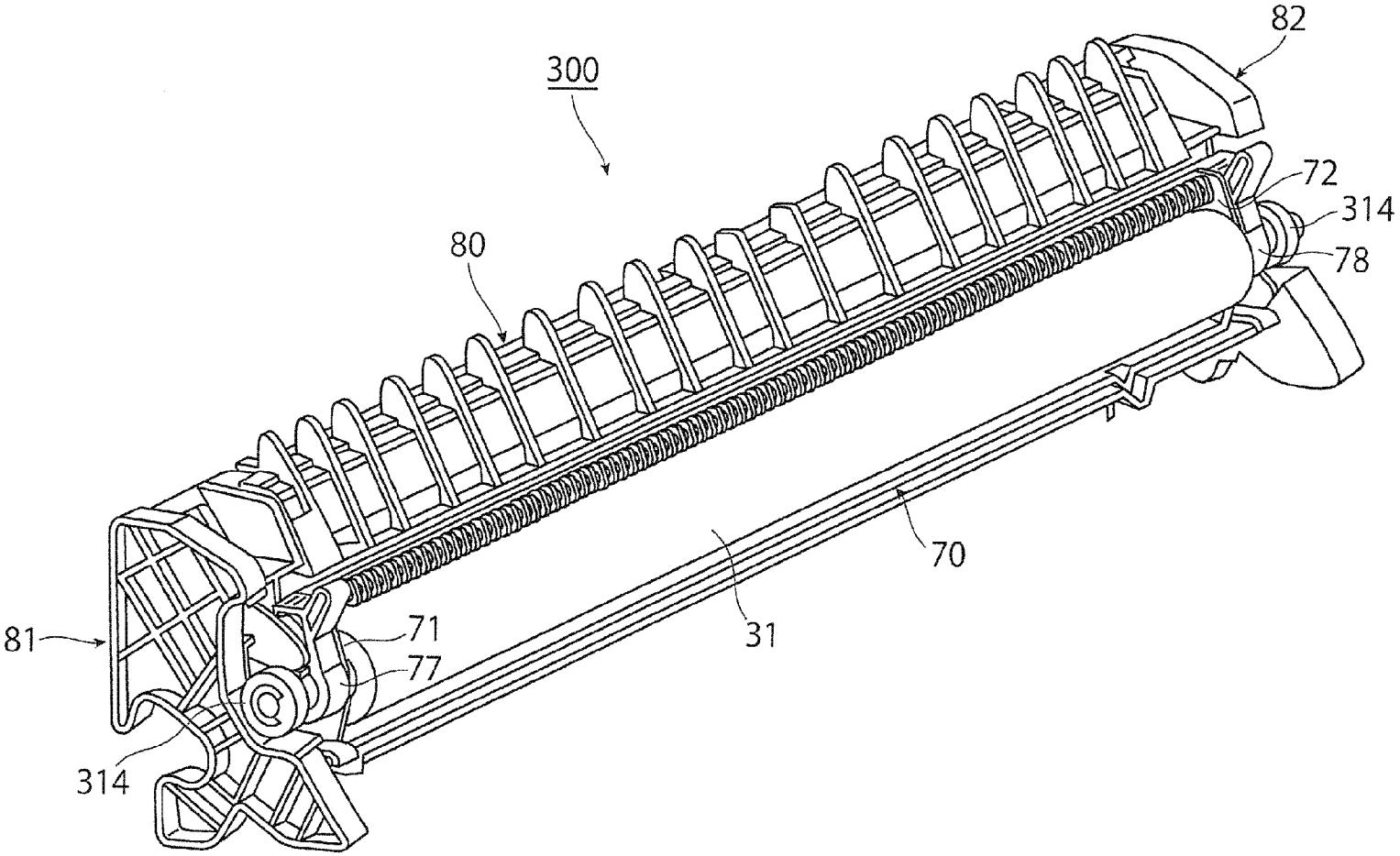
FIG. 5 is a perspective configuration view illustrating a secondary transfer unit.

As illustrated in FIG. 5, the secondary transfer unit 300 is roughly configured with the secondary transfer roll 31, a holding member 70 that holds the secondary transfer roll 31, and an attachment housing 80 as an example of the attaching unit that attaches the secondary transfer roll 31 to the side cover 110 via the holding member 70. In addition, in a case of exchanging the secondary transfer roll 31, it is not necessary to exchange the entire secondary transfer unit 300, and only the holding member 70 that holds the secondary transfer roll 31 may be exchanged.

Figure 6:
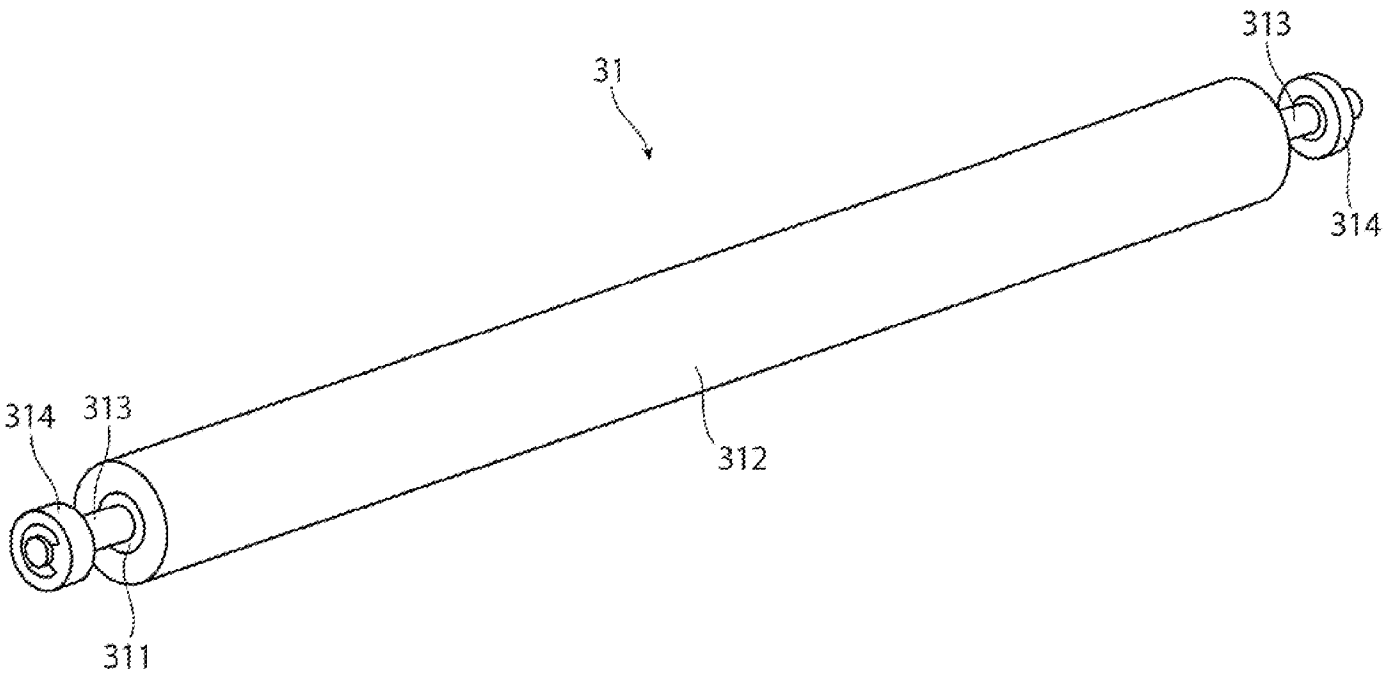
FIG. 6 is a perspective configuration view illustrating a secondary transfer roll.
Figure 8:
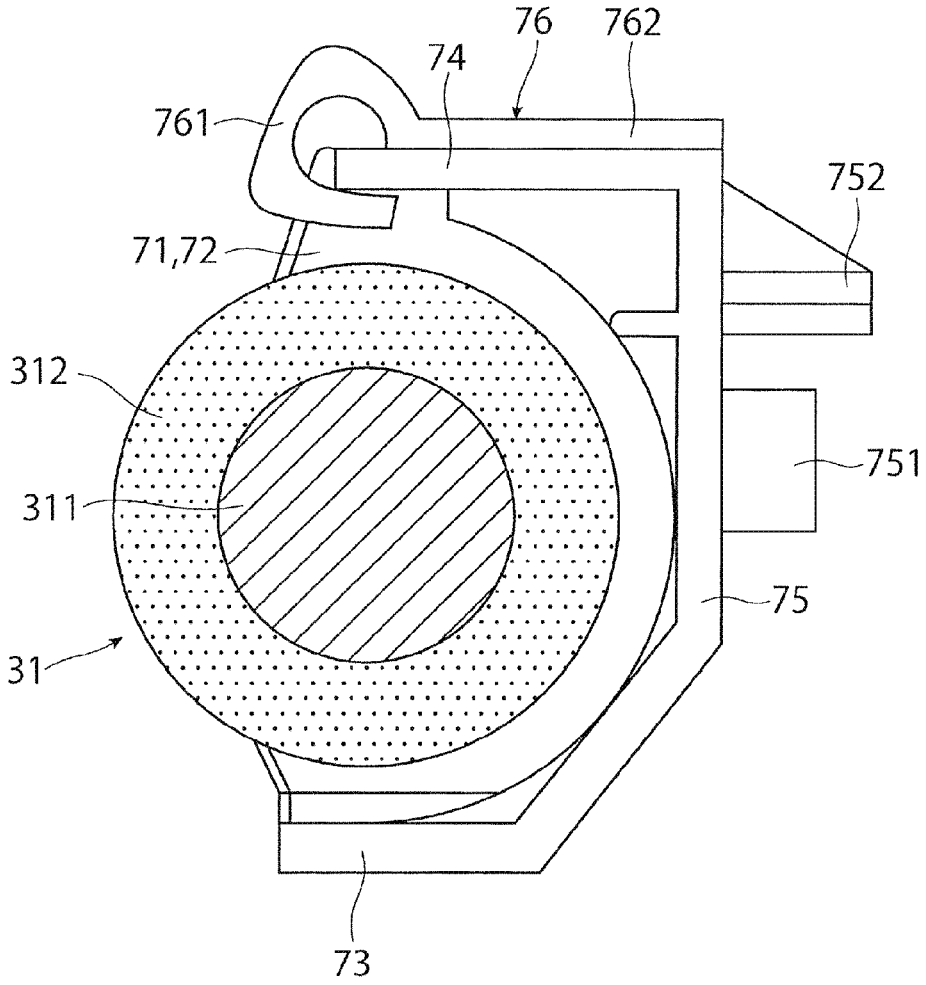
FIG. 8 is a sectional configuration view illustrating the holding member that holds the secondary transfer roll.

As illustrated in FIGS. 6 and 8, the secondary transfer roll 31 includes a columnar core metal member 311 having a relatively large outer diameter made of metal, such as stainless steel, a semiconductive elastic layer 312 made of foamed rubber or the like compounded with epichlorohydrin rubber and nitrile rubber coated on the outer periphery of the core metal member 311, a rotation shaft 313 having a smaller outer diameter than that of the core metal member 311 integrally provided at both end portions along the axial direction of the core metal member 311. The secondary transfer roll 31 is adjusted to have a required resistance value by adding a conductive agent to the elastic layer 312. A bearing member 314 formed of a ball bearing or the like is mounted in both end portions of the secondary transfer roll 31 along the axial direction of the rotation shaft 313. When the side cover 110 is closed, the secondary transfer roll 31 is positioned and fixed at the predetermined secondary transfer position T2 of the apparatus main body 1*a* via the bearing member 314. The secondary transfer roll 31 is attached to the attachment housing 80 via the holding member 70 that holds the rotation shaft 313 in a rotatable state.

Figure 7:
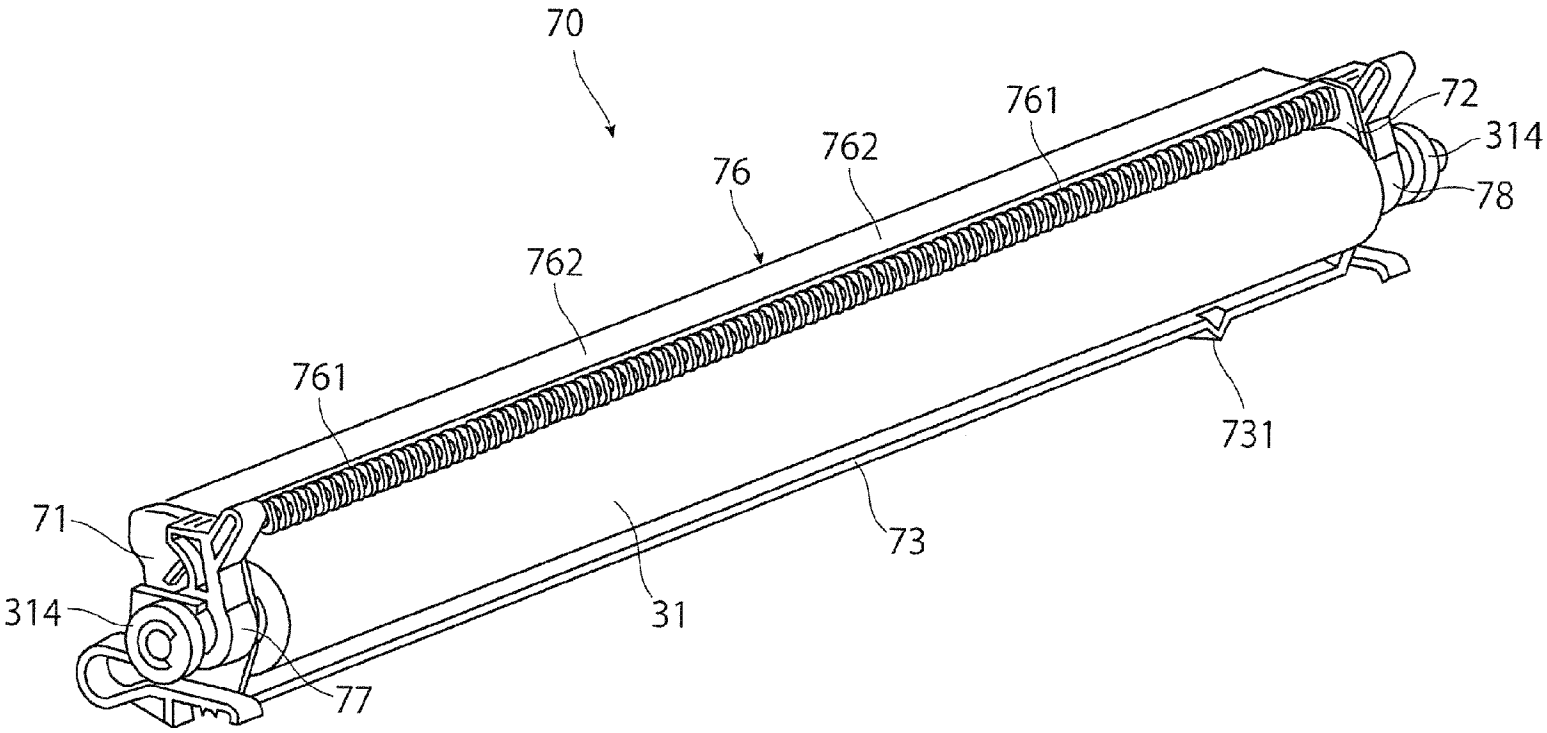
FIG. 7 is a perspective configuration view illustrating a holding member that holds the secondary transfer roll.

As illustrated in FIGS. 7 and 8, the holding member 70 is configured with left and right side plates 71 and 72 which are respectively disposed at both end portions along the axial direction of the secondary transfer roll 31, a bottom plate 73 that covers the lower portion of the secondary transfer roll 31, a ceiling plate 74 that covers the upper portion of the secondary transfer roll 31, and a rear surface plate 75 that covers the rear surface of the secondary transfer roll 31, as an elongated box having a substantially rectangular parallelepiped shape in which a side that faces the inside of the apparatus main body 1*a* is opened. The rear surface plate 75 of the holding member 70 is provided with a projection 752 (refer to FIG. 8) for positioning and fixing the holding member 70 on the attachment housing 80 toward the rear surface side. In FIG. 7, a reference numeral 731 indicates a substantially V-shaped convex portion provided on the bottom plate 73 for positioning when attaching the holding member 70 to the attachment housing 80.

Figure 9:
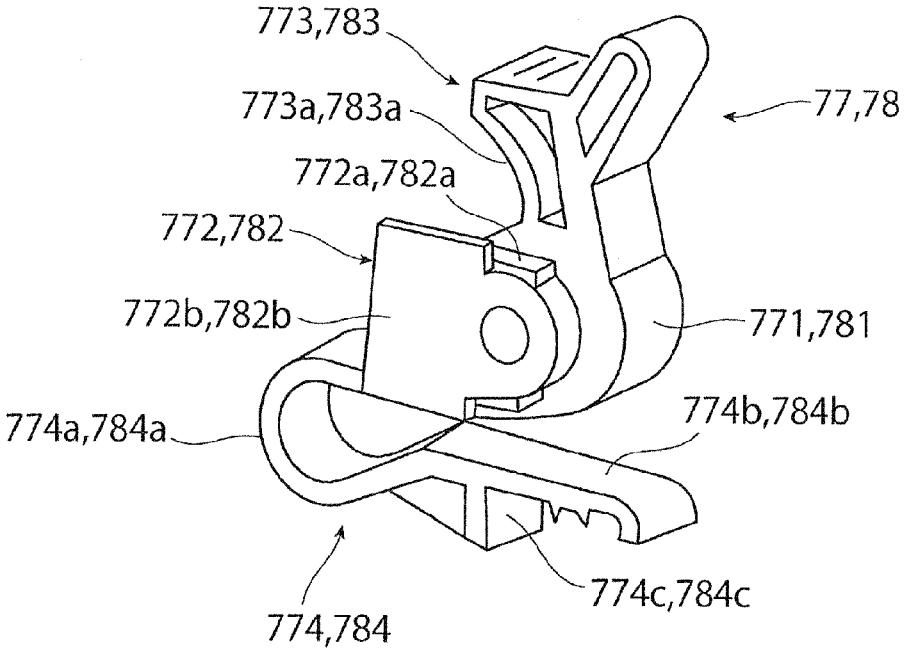
FIG. 9 is a perspective configuration view illustrating first and second mounting portions of the holding member.

On both side plates 71 and 72 of the holding member 70, as illustrated in FIG. 7, on the outer side along the axial direction of the secondary transfer roll 31, detachable members 77 and 78 for detachably attaching to the secondary transfer roll 31 to the attachment housing 80 via the holding member 70, are provided. In the detachable members 77 and 78, as illustrated in FIG. 9, substantially cylindrical holding portions 771 and 781 for holding the secondary transfer roll 31 in a rotatable state via the rotation shaft 313, attaching plate portions 772 and 782 provided to be projected in a flat plate shape having a rectangular side surface toward the rear surface side on the outer surface along the axial direction of the secondary transfer roll 31 of the holding portions 771 and 781, and first and second mounting portions 773, 783, 774 and 784 which are respectively provided above and below the holding portions 771 and 781 and detachably mount the holding member 70 that holds the secondary transfer roll 31 to the attachment housing 80, are integrally formed.

The attaching plate portions 772 and 782 of the detachable members 77 and 78 are configured with first flat plate portions 772*a* and 782*a* formed in a flat plate shape having a rectangular side surface and having a relatively thick thickness on the outer surface of the holding portions 771 and 781, and second flat plate portions 772*b* and 782*b* that have a thinner plate thickness than that of the first flat plate portions 772*a* and 782*a* on the outer side of the first flat plate portions 772*a* and 782*a*, are projected vertically, and are formed in a flat plate shape having a rectangular side surface for being positioned at a predetermined attaching position of the attachment housing 80.

The first mounting portions 773 and 783 provided in the upper portions of the detachable members 77 and 78 are formed to have a substantially Y-shaped side surface, and when attaching and detaching the holding member 70 to and from the attachment housing 80, the first mounting portions 773 and 783 function as a first gripping portion for the operator to hook an index finger or a thumb and to grip the holding member 70. The first mounting portions 773 and 783 are provided in a state of being fixed to both side plates 71 and 72 of the holding member 70.

Meanwhile, the second mounting portions 774 and 784 provided in the lower portions of the detachable members 77 and 78 are configured with plate spring portions 774*a* and 784*a* which are disposed in a substantially U shape facing horizontally from the lower ends of the holding portions 771 and 781 toward the rear surface side and in which elastic deformation is possible, gripping portions 774*a* and 784*b* which are provided to be projected in a flat plate shape on the front surface sides of the plate spring portions 774*a* and 784*a*, and function as second gripping portions for the operator to hook a thumb or an index finger and to grip the holding member 70 when mounting the holding member 70 onto the attachment housing 80, and engagement pieces 774*c* and 784*c* provided on the lower end surfaces of the gripping portions 774*b* and 784*b* so as to be projected downward in a short flat plate shape. The second mounting portions 774 and 784 mount both side plates 71 and 72 of the holding member 70 onto the attachment housing 80 as the engagement pieces 774*c* and 784*c* are locked to locking plate portions 933 and 943 (refer to FIG. 11) of the attachment housing 80.

The bearing members 314 of the secondary transfer roll 31 are respectively disposed on the outer side of the detachable members 77 and 78 along the axial direction of the secondary transfer roll 31 in a state where the secondary transfer roll 31 is held by the holding member 70. On both side plates 71 and 72 of the holding member 70, cutouts (not illustrated) are provided so as not to be in contact with the rotation shaft 313 of the secondary transfer roll 31.

As illustrated in FIGS. 7 and 8, a charge removing member 76 which is disposed on the exit side of the secondary transfer position T2 of the secondary transfer roll 31 and removes charges while being in contact with the rear surface of the recording paper 5, is attached to the ceiling plate 74 of the holding member 70. The charge removing member 76 is formed of a conductive synthetic resin, metal or the like, and is grounded. In the charge removing member 76, plural charge removing portions 761 formed in an elongated ring shape along the transport direction of the recording paper 5 so as to be uniformly in contact with the rear surface of the recording paper 5 are arranged at required pitch along the direction intersecting the transport direction of the recording paper 5. In addition, the charge removing member 76 integrally has a substrate 762 disposed on the rear surface side of the plural charge removing portions 761. The charge removing member 76 is attached to the ceiling plate 74 of the holding member 70 by means of screwing or the like via the substrate 762.

Figure 10:
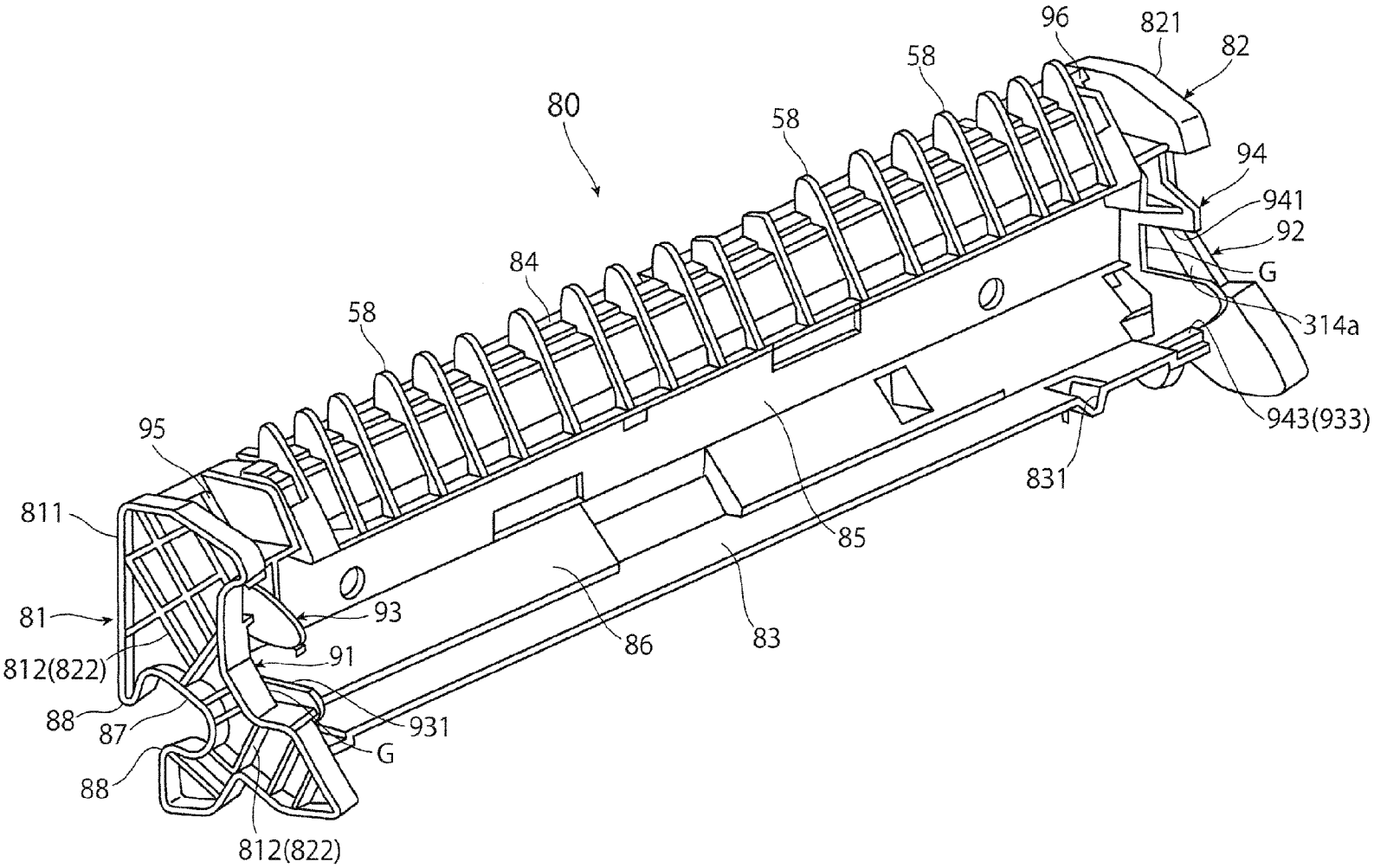
FIG. 10 is a perspective configuration view illustrating an attachment housing.
Figure 11:
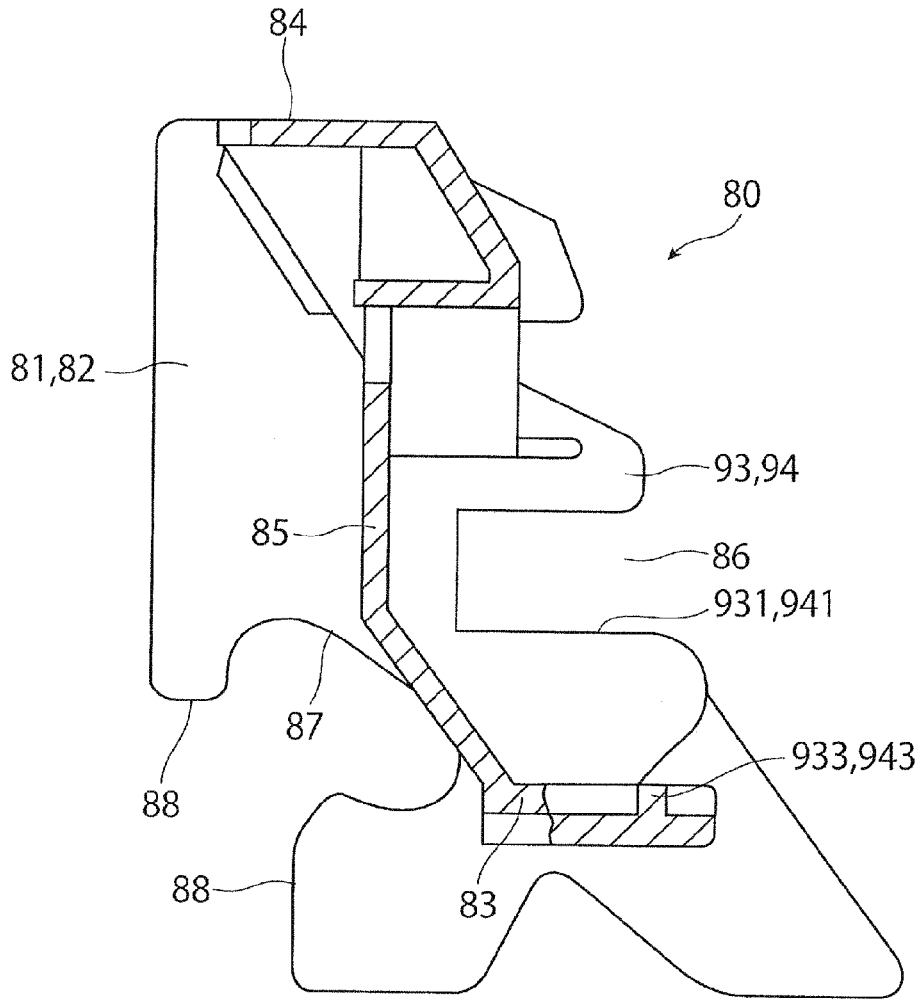
FIG. 11 is a sectional configuration view illustrating the attachment housing.

As illustrated in FIGS. 10 and 11, the attachment housing 80 of the secondary transfer unit 300 is integrally configured as a substantially rectangular parallelepiped frame body having an opening portion 86 directed to the inside of the apparatus main body 1*a* by injection molding of a synthetic resin or the like. The attachment housing 80 includes left and right side wall portions 81 and 82 having substantially rectangular side surfaces which are respectively disposed in both end portions along the axial direction of the secondary transfer roll 31, a bottom wall portion 83 disposed in the lower portion of the holding member 70 that holds the secondary transfer roll 31, a ceiling wall portion 84 disposed in the upper portion of the holding member 70, and a rear surface wall portion 85 disposed on the rear surface side of the holding member 70. The attachment housing 80 is attached such that the secondary transfer roll 31 is exposed to the outside from the opening portion 86 thereof. In FIG. 10, a reference numeral 831 indicates a substantially V-shaped recessed portion which is engaged with the substantially V-shaped convex portion 731 of the holding member 70 and is provided in the bottom wall portion 83 for positioning the holding member 70 when attaching the holding member 70 to the attachment housing 80.

Figure 12:
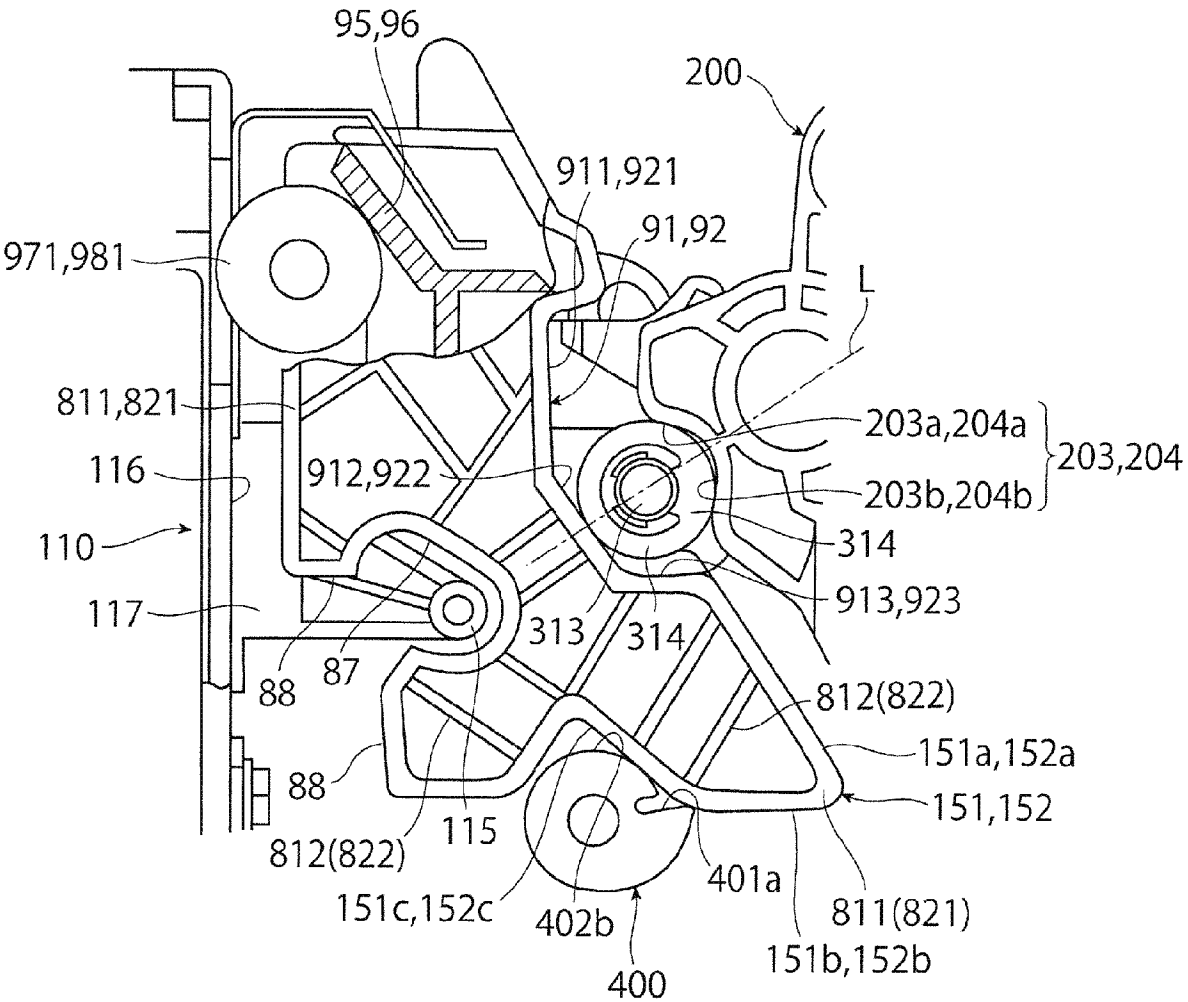
FIG. 12 is a sectional configuration view illustrating a main part of the color image forming apparatus in a state where the side cover is closed.

As illustrated in FIGS. 10 and 12, both side wall portions 81 and 82 of the attachment housing 80 are reinforced by flange portions 811 and 821 provided at the outer peripheral end edge outward along the thickness direction across the entire periphery, and plural reinforcing ribs 812 and 822 provided in a flat plate shape intersecting or parallel to each other on the surface on the outside. As illustrated in FIG. 11, the attachment housing 80 is configured to be unlikely to be deformed even in a case of holding the secondary transfer roll 31 that includes a core metal member 311 having a relatively large outer diameter and has a relatively heavy weight, by connecting the reinforced both side wall portions 81 and 82 to each other by the bottom wall portion 83, the ceiling wall portion 84, the rear surface wall portion 85, and the like.

In both side wall portions 81 and 82 of the attachment housing 80, in the lower portion on the side cover 110 side, long holes 87, in which the end portion on the side cover 110 side along the long diameter direction is positioned at the upper part along the vertical direction, and the end portion on the apparatus main body 1*a* side long the long diameter direction is disposed to be inclined so as to be positioned at the lower part along the vertical direction, are respectively provided. In addition, in both side wall portions 81 and 82 of the attachment housing 80, large cut-out portions 88 cut out across the vicinity of the center of the lower end edge along the long diameter direction from the lower part on the side cover 110 side along the long diameter direction of the long hole 87, are provided. The long hole 87 communicates with the outside positioned in the lower end portion on the side cover 110 side via the cutout portion 88.

Meanwhile, in the side cover 110, as illustrated in FIG. 12, support shafts 115 that are inserted into the long hole 87 of both side wall portions 81 and 82 of the attachment housing 80 and support the lower portions of both side wall portions 81 and 82 of the attachment housing 80, are respectively provided. The support shaft 115 is formed in a short columnar shape directed outward in the axial direction of the secondary transfer roll 31 at the end part of a support member 117 having a substantially triangular side surface attached to a substrate (tie plate) 116 made of sheet metal or the like of the side cover 110. The support members 117 including the support shaft 115 are respectively disposed in both end portions along the axial direction of the secondary transfer roll 31 corresponding to both side wall portions 81 and 82 of the attachment housing 80. Each of the support shafts 115 of the side cover 110 is inserted into the long hole 87 of the attachment housing 80 via the cutout portion 88 when the attachment housing 80 is attached to the side cover 110. Therefore, the attachment housing 80 is not fixed to the side cover 110 but is movably attached via the long hole 87. In addition, FIG. 12 illustrates a state where the side cover 110 is closed and the secondary transfer roll 31 is positioned and fixed at the secondary transfer position T2.

On both side wall portions 81 and 82 of the attachment housing 80, fixing recesses 91 and 92 for positioning and fixing the secondary transfer roll 31 are provided on the end surface positioned on the inside of the apparatus main body 1*a*. The fixing recesses 91 and 92 include vertical surfaces 911 and 921 that are disposed along the vertical direction from a position at which the upper end portion is recessed toward the side cover 110 side, inclined surfaces 912 and 922 that are disposed to be inclined toward the inside of the apparatus main body 1*a* from the lower end portion of the vertical surfaces 911 and 921, and horizontal surfaces 913 and 923 that are disposed along the horizontal direction toward the inside of the apparatus main body 1*a* from the lower end portion of the inclined surfaces 912 and 922, at the position that corresponds to the belt support roll (backup roll) 25 of the intermediate transfer unit 200. The inclined surfaces 912 and 922 of the fixing recesses 91 and 92 disposed to be substantially orthogonal to a straight line L, that connects the centers of the secondary transfer roll 31 and the belt support roll 25 to each other. On the inclined surfaces 912 and 922 of the fixing recesses 91 and 92, the outer peripheral surface of the bearing member 314 of the secondary transfer roll 31 fixed to the attachment housing 80 via the holding member 70 is disposed to be in contact therewith. In the attachment housing 80, as illustrated in FIG. 10, a metal connection plate 314*a* for connecting the core metal member 311 of the secondary transfer roll 31 to the ground via the bearing member 314 from the vertical surface 921 to the inclined surface 922 in one fixing recess 92. In addition, FIG. 12 illustrates a state where the secondary transfer roll 31 is fixed to the secondary transfer position T2 which is an operation position.

The positioning recessed portions 203 and 204 provided on the front and rear side frames 201 and 202 of the intermediate transfer unit 200 are formed in a substantially V-shape opened to be directed obliquely downward, which is the direction of the secondary transfer roll 31, as illustrated in FIG. 12. The positioning recessed portions 203 and 204 have upper and lower inner peripheral surfaces 203*a* and 204*a* that are respectively in contact with the outer peripheral surface of the bearing member 314 of the secondary transfer roll 31. The centers of the positioning recessed portions 203 and 204 where the upper and lower inner peripheral surfaces 203*a* and 204*a* intersect each other are set to have a smaller radius of curvature than that of the outer peripheral surface of the bearing member 314 of the secondary transfer roll 31. Therefore, a slight gap with which the bearing member 314 of the secondary transfer roll 31 is not in contact is formed at the centers of the positioning recessed portions 203 and 204.

Figure 13:
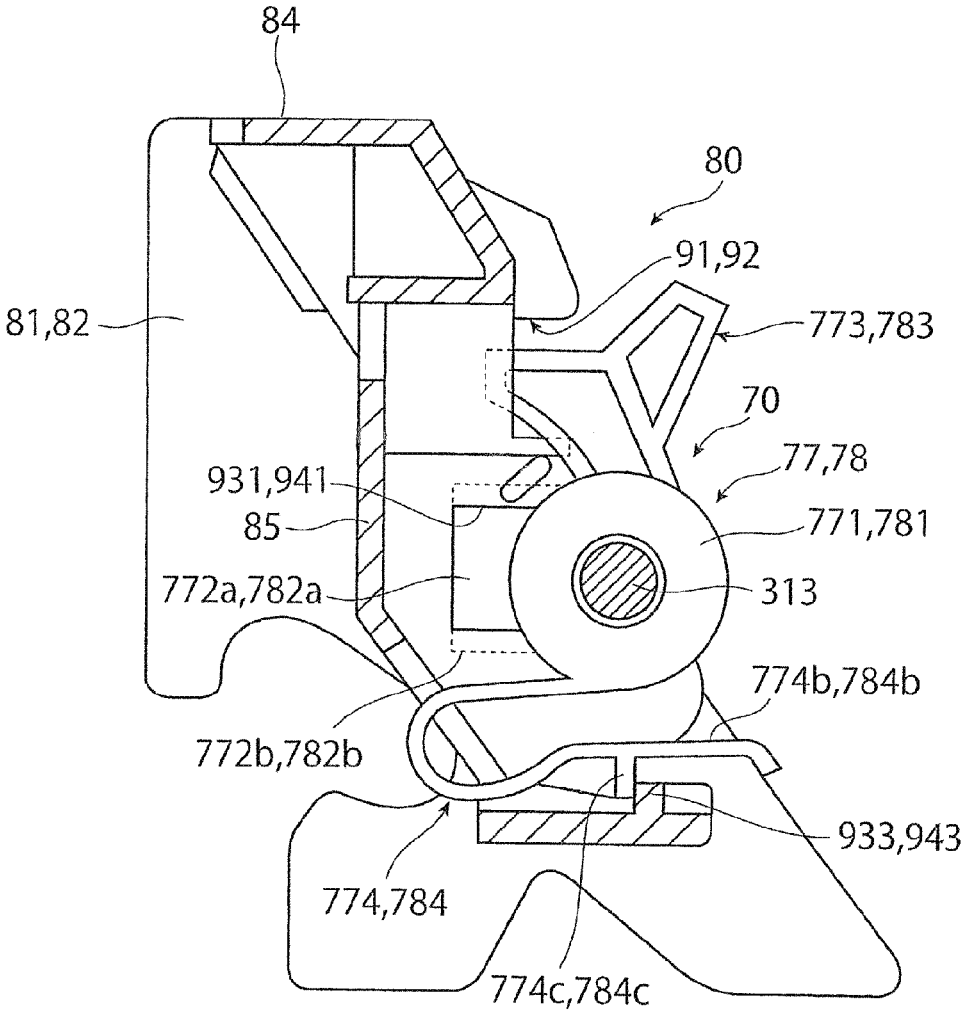
FIG. 13 is a sectional configuration view illustrating a state where the holding member is mounted on the attachment housing.

In addition, in both side wall portions 81 and 82 of the attachment housing 80, as illustrated in FIG. 10, left and right attaching plate portions 93 and 94 which are disposed in parallel with both side wall portions 81 and 82 via a slight gap G, are respectively provided on the inner side along the axial direction of the secondary transfer roll 31. As illustrated in FIG. 11, the left and right attaching plate portions 93 and 94 are integrally connected to the bottom wall portion 83, the ceiling wall portion 84, the rear surface wall portion 85, and the like of the attachment housing 80. In both attaching plate portions 93 and 94, at positions that correspond to fixing recesses 91 and 92 of both side wall portions 81 and 82, attaching recessed portions 931 and 941 having a rectangular side surface for fixing the detachable members 77 and 78 of the holding member 70 are provided. As illustrated in FIG. 13, the first flat plate portions 772*a* and 782*a* of the attaching plate portions 772 and 782 of the detachable members 77 and 78 are fixed to the attaching recessed portions 931 and 941 in a fitted state. The second flat plate portions 772*b* and 782*b* of the attaching plate portions 772 and 782 of the detachable members 77 and 78 are positioned being inserted into the gap G (refer to FIG. 10) formed between both side wall portions 81 and 82 and attaching plate portions 93 and 94.

In addition, the second engaging portions 933 and 943, with which the second mounting portions 774 and 784 of the detachable members 77 and 78 are engaged, are respectively provided on the inside of both attaching plate portions 93 and 94. The second engaging portions 933 and 943 are configured with rising plates provided so as to stand on step portions provided one step lower at both ends along the longitudinal direction of the bottom wall portion 83 of the attachment housing 80. The second engaging portions 933 and 943 are fixed by engaging the engagement pieces 774*c* and 784*c* of the second mounting portions 774 and 784 therewith.

In addition, in the upper portions of both side wall portions 81 and 82 of the attachment housing 80, as illustrated in FIGS. 10 and 12, inclined plate portions 95 and 96, which are inclined such that the upper end portion is positioned on the side cover 110 side and the lower end portion is positioned on the apparatus main body 1*a* side, are respectively provided on the inner side along the longitudinal direction of the attachment housing 80. In each of the inclined plate portions 95 and 96, as illustrated in FIGS. 14 and 15, by receiving a pressing force from the first and second rollers 971, 981, 972, and 982 of pressing mechanisms 97 and 98 as an example of the rotation biasing unit disposed on the rear surface side, a rotational force for rotating the attachment housing 80 in a clockwise direction with the support shaft 115 as a fulcrum acts constantly.

Figure 14:
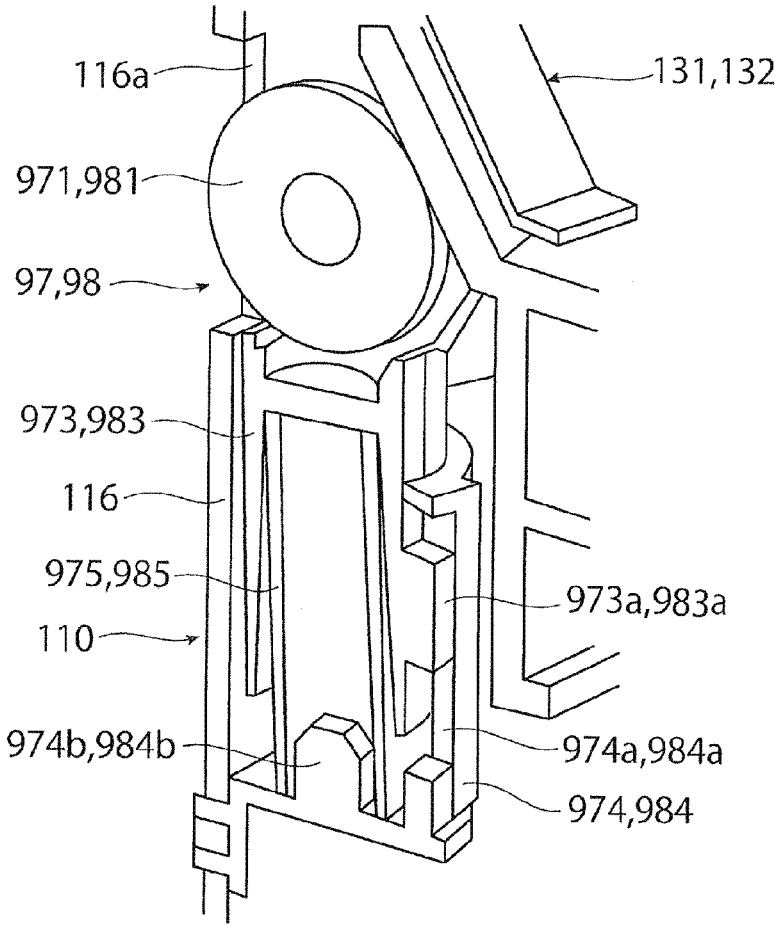
FIG. 14 is a perspective configuration view illustrating a pressing mechanism of the side cover.
Figure 15:
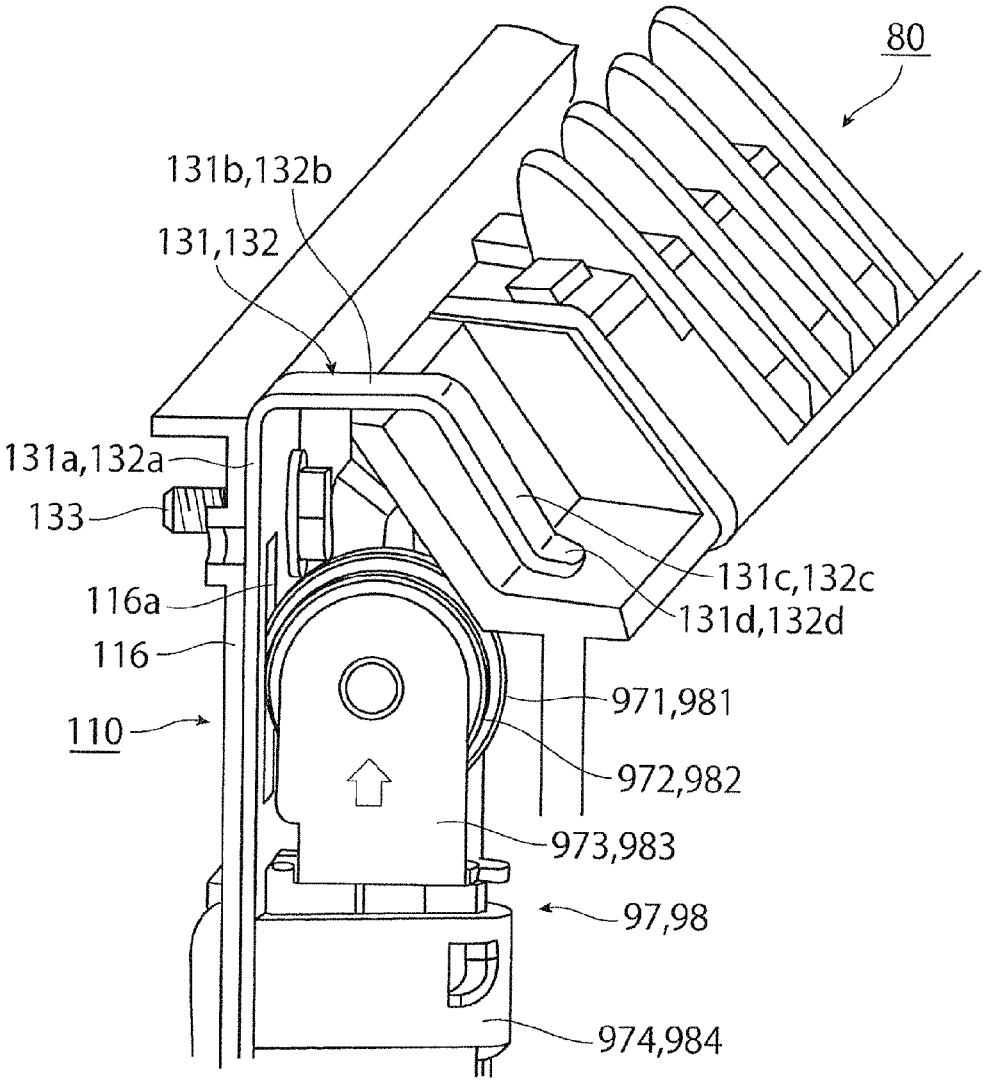
FIG. 15 is a perspective configuration view illustrating the pressing mechanism of the side cover.

As illustrated in FIGS. 14 and 15, the pressing mechanisms 97 and 98 include first rollers 971 and 981 as an example of a first rotating body that rotates along both inclined plate portions 95 and 96 of the attachment housing 80, second rollers 972 and 982 which are coaxially disposed on both sides of the first rollers 971 and 981, have a smaller outer diameter than that of the first rollers 971 and 981, and rotate along the substrate 116 of the side cover 110, movable members 973 and 983 for supporting the first and second rollers 971, 981, 972, and 982 so as to be separately rotatable, fixing members 974 and 984 for movably supporting the movable members 973 and 983 along the vertical direction, and coil springs 975 and 985 as an example of the biasing unit that is interposed between the movable members 973 and 983 and the fixing members 974 and 984 and biases the movable members 973 and 983 upward.

The movable members 973 and 983 support, in a rotatable state, the first and second rollers 971, 981, 972, and 982 in the upper end portions thereof, and are formed in a cylindrical shape of which the upper end portions are closed. The fixing members 974 and 984 are formed in a bottomed cylindrical shape in which the surface on the side cover 110 side is opened. On one side surface of the movable members 973 and 983, as illustrated in FIG. 14, regulating convex portions 973*a* and 983*a*, which are disposed in opening portions 974*a* and 984*a* of the fixing member 974 and 984 and regulate a movable range along the vertical direction of the movable members 973 and 983, are provided. At the bottom portion of the fixing member 974 and 984, projections 974*b* and 984*b* for positioning the coil spring 975 and 985 are provided.

On the substrate 116 of the side cover 110, a slit 116*a* for vertically moving the first rollers 971 and 981 in a non-contact state is provided. The second rollers 972 and 982 rotate while being in contact with the inner surface of the substrate 116 of the side cover 110 on both sides of the slit 116*a*.

In this manner, the reason why the pressing mechanisms 97 and 98 are configured with the first rollers 971 and 981 and the second rollers 972 and 982 having different outer diameters is as follows. This is for avoiding a situation in which, in a case where the pressing mechanisms 97 and 98 are configured with a single rotating body, the single rotating body enters a space having a substantially triangular (wedge-like) section formed with the substrate 116 of the side cover 110 and the rear surface of both inclined plate portions 95 and 96 of the attachment housing 80, is pinched between the substrate 116 of the side cover 110 and the rear surface of both inclined plate portions 95 and 96 of the attachment housing 80, and cannot move. By configuring the pressing mechanisms 97 and 98 with the first rollers 971 and 981 and the second rollers 972 and 982 having different outer diameters, the first rollers 971 and 981 can move along the vertical direction while being in contact with the rear surface of both inclined plate portions 95 and 96 of the attachment housing 80, and the second rollers 972 and 982 can move along the vertical direction independently from the first rollers 971 and 981 while being in contact with the substrate 116 of the side cover 110.

The side cover 110 is provided with regulating plates 131 and 132 which respectively abut against both inclined plate portions 95 and 96 of the attachment housing 80 and regulate the inclination movement of the upper end portion of the attachment housing 80. As illustrated in FIG. 15, the regulating plates 131 and 132 include vertical plate portions 131*a* and 132*a* fixed to the substrate 116 of the side cover 110 by bolts 133, horizontal plate portions 131*b* and 132*b* bent along the horizontal direction at the upper ends of the vertical plate portions 131*a* and 132*a*, and inclined plate portions 131*c* and 132*c* inclined obliquely downward to be substantially parallel to both inclined plate portions 95 and 96 at the end parts of horizontal plate portions 131*b* and 132*b*. In addition, the end parts 131*d* and 132*d* of the inclined plate portions 131*c* and 132*c* are bent to be short along the horizontal direction.

Figure 16:
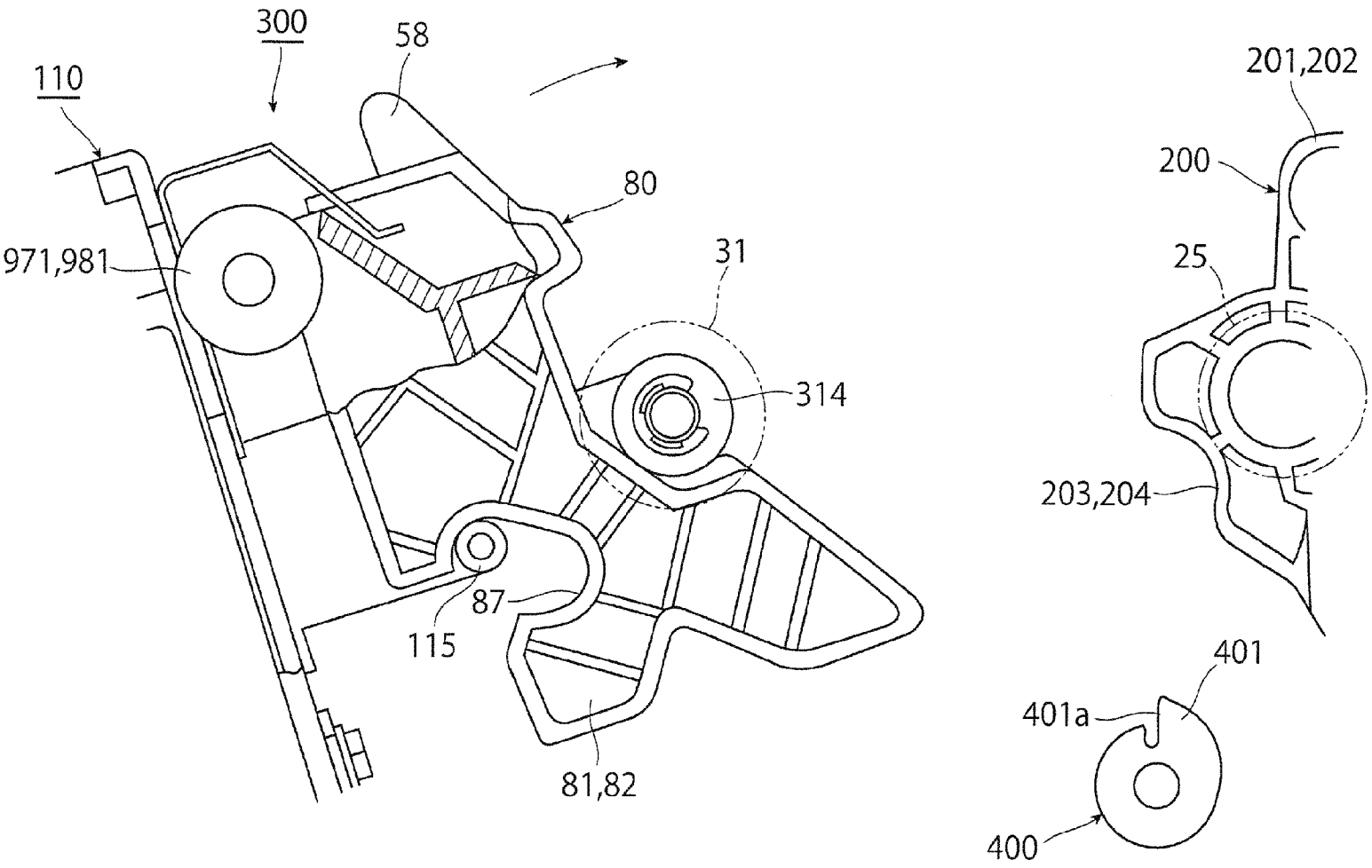
FIG. 16 is a sectional view illustrating a state in the middle of closing the side cover.

As illustrated in FIG. 16, in a state where the side cover 110 is opened, the lower portion of the attachment housing 80 stops in a state where the upper end portions of the long holes 87 of both inclined plate portions 95 and 96 are in contact with the support shaft 115 of the side cover 110 under the own weight, and the upper portion of the attachment housing 80 stops in a state where both inclined plate portions 95 and 96 receive the pressing force from the first rollers 971 and 981 of the pressing mechanisms 97 and 98 and rotate in a counterclockwise direction, and the surfaces of both inclined plate portions 95 and 96 abut against the inclined plate portions 131*c* and 132*c* of the regulating plates 131 and 132 of the side cover 110. At this time, it is needless to say that the secondary transfer roll 31 is separated from the apparatus main body 1*a*, and the secondary transfer roll 31 moves to the temporary holding position different from the operation position illustrated in FIG. 12 with respect to the side cover 110, The attachment housing 80 functions as the attaching unit that attaches the secondary transfer roll 31 to the side cover 110 so as to be movable between the transfer position and the temporary holding position when opening and closing the side cover 110, by the long holes 87 and the regulating plates 131 and 132 of the side cover 110.

As illustrated in FIG. 10, the transporting guide member 58 that configures the paper transporting path 59 is mounted on the ceiling wall portion 84 of the attachment housing 80.

In both side wall portions 81 and 82 of the attachment housing 80, as illustrated in FIG. 12, at the end portion of the bottom surface on the apparatus main body 1*a* side, the guide positioning portions 151 and 152 for guiding and positioning the attachment housing 80 with respect to the apparatus main body 1*a* when closing the side cover 110, are provided. In the guide positioning portions 151 and 152, the lower end surfaces projected toward the apparatus main body 1*a* side are formed to have a substantially triangular flat side surface on the bottom surfaces of both side wall portions 81 and 82. The guide positioning portions 151 and 152 have a substantially triangular side surface which is formed with inclined portions 151*a* and 152*a* inclined downward on the inside of the apparatus main body 1*a* from the end parts of the fixing recesses 91 and 92 of both side wall portions 81 and 82, and bottoms 151*b* and 152*b* which intersect the inclined portions 151*a* and 152*a* to make an acute angle and are provided linearly along the bottom surfaces of both side wall portions 81 and 82. On the bottoms 151*b* and 152*b* of the guide positioning portions 151 and 152, cutout portions 151*c* and 152*c* formed in a substantially V-shape downward at an intermediate position on the side cover 110 side, are provided.

Incidentally, as illustrated in FIG. 4, the secondary transfer unit 300 moves together with the side cover 110 along with the opening and closing operation of the side cover 110, and is positioned and fixed at the predetermined secondary transfer position T2 of the apparatus main body 1*a* when the side cover 110 is closed.

Therefore, in the apparatus main body la of the color image forming apparatus 1, as illustrated in FIGS. 4 and 12, a guide member 400 as an example of a guiding unit that is in contact with the guide positioning portions 151 and 152 of both side wall portions 81 and 82 of the attachment housing 80 provided in the side cover 110, when closing the side cover 110, and guides the secondary transfer roll 31 attached to the attachment housing 80 to the secondary transfer position T2 which is the operation position from the temporary holding position, is provided.

However, depending on the configuration of the guide member 400 provided on the apparatus main body 1*a* side of the color image forming apparatus 1, when closing the side cover 110, the end parts of the guide positioning portions 151 and 152 of the attachment housing 80 interfere with the guide member 400, and accordingly, there is a concern that the secondary transfer roll 31 mounted on the attachment housing 80 cannot be reliably guided from the temporary holding position to the secondary transfer position T2.

Figure 17A:
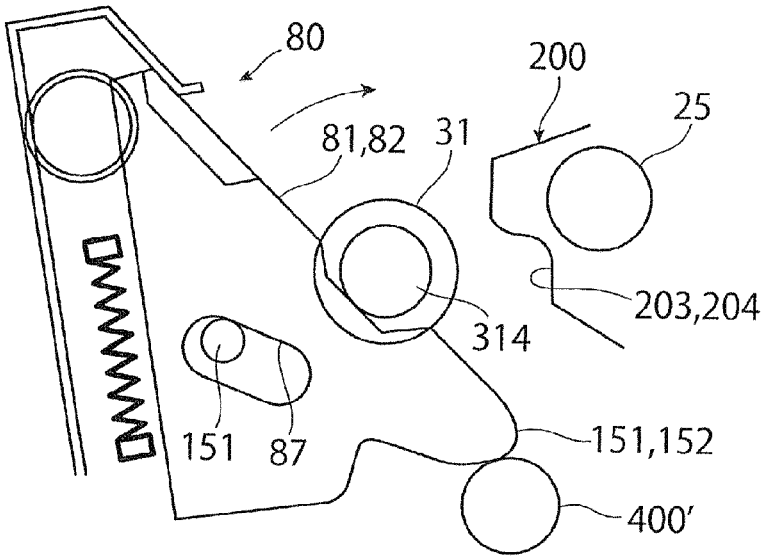
FIGS. 17A and 17B are schematic views illustrating a state where the side cover of the related art is closed.
Figure 17B:
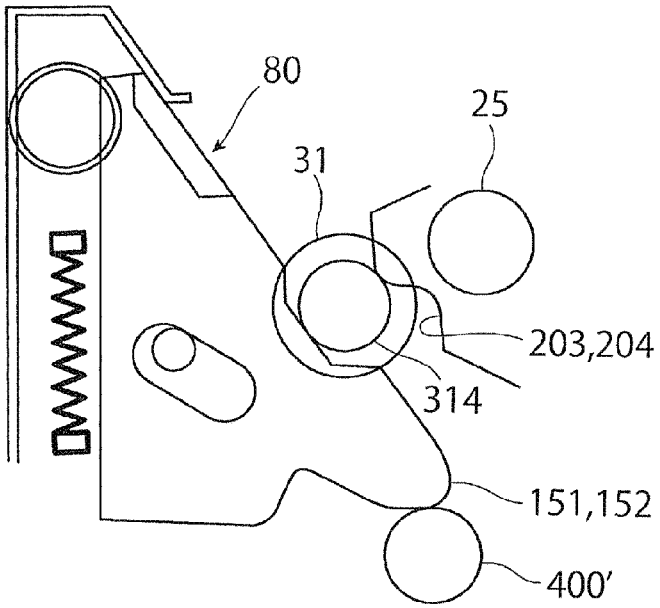

When explaining further, as schematically illustrated in FIGS. 17A and 17B, a guide member 400' of the related art is formed in a cylindrical shape, and is fixed and disposed at a predetermined position on the inner surface of the apparatus main body 1*a*. Therefore, in the guide member 400' of the related art, when closing the side cover 110, there is a concern that the end parts of the guide positioning portions 151 and 152 of the attachment housing 80 abut against the guide member 400'. There is a case where the guide positioning portions 151 and 152 of the attachment housing 80 are guided so as to abut against the guide member 400' and get on the guide member 400'. Then, when the side cover 110 is closed, the attachment housing 80 is guided to rotate along the clockwise direction with the guide member 400' as a fulcrum, and as illustrated in FIG. 17B, the bearing member 314 of the secondary transfer roll 31 mounted on the attachment housing 80 abuts against the substantially vertical side surface positioned at the upper ends of the positioning recessed portions 203 and 204 provided in the intermediate transfer unit 200, the operation force when closing the side cover 110 excessively increases, finally the bearing member 314 is not correctly positioned in the positioning recessed portions 203 and 204, and accordingly, there is a concern that the secondary transfer roll 31 is shifted from the secondary transfer position T2 and the second transfer failure occurs.

Here, in Exemplary Embodiment 1, as illustrated in FIGS. 4 and 18, a configuration in which the apparatus main body 1*a* is provided, an abutting portion 401 as an example of the cutout portion that rotates while being in contact with the guide positioning portions 151 and 152 of both side wall portions 81 and 82 of the attachment housing 80 when the side cover 110 is closed is provided, and the eccentric cam member 400 as an example of the rotating unit that guides the secondary transfer roll 31 attached to the attachment housing 80 to move to the secondary transfer position T2 from the temporary holding position is provided, is employed. When closing the side cover 110, the eccentric cam member 400 is attached to be rotatable via a support shaft 410 fixed to an inner frame 1*a'* of the apparatus main body 1*a* positioned respectively on both sides along the longitudinal direction of the attachment housing 80 of the secondary transfer unit 300 mounted on the side cover 110.

Figure 18A:
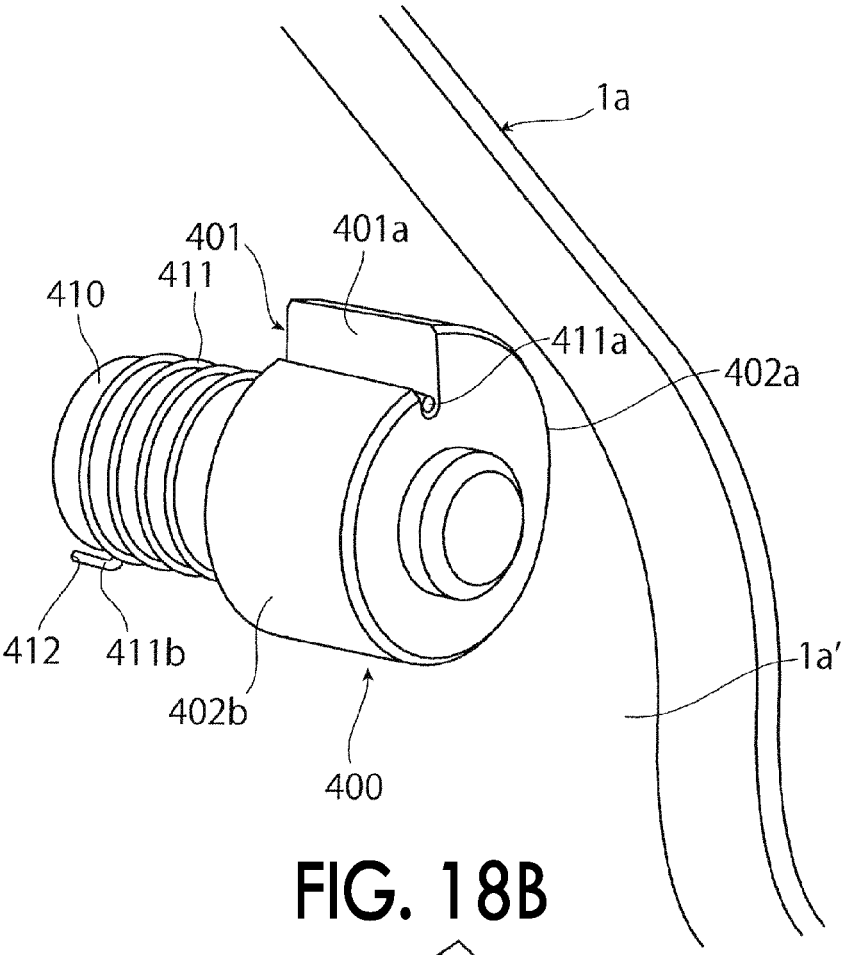
FIGS. 18A and 18B are perspective configuration views and a front configuration view illustrating an attached state of an eccentric cam member.
Figure 18B:
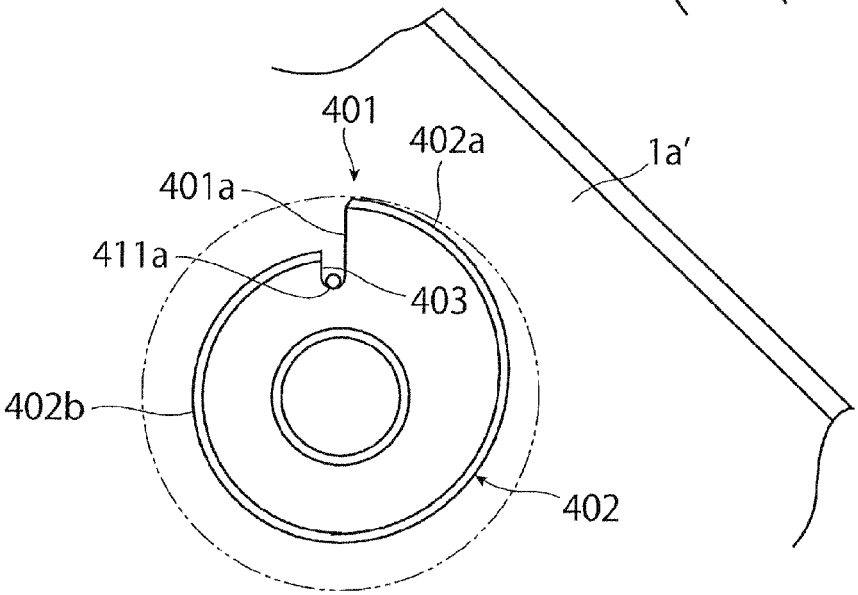

As illustrated in FIGS. 18A and 18B, the eccentric cam member 400 includes: the abutting portion 401 that abuts against the end parts of the guide positioning portions 151 and 152 of the attachment housing 80 and rotates the eccentric cam me fiber 400; and the eccentric portion 402 that is so eccentric as to have a gradually increasing outer diameter along the counterclockwise direction from the abutting portion 401.

The abutting portion 401 of the eccentric cam member 400 is configured with an abutting surface 401*a* formed outward along the radial direction from the center, and a diameter expansion eccentric portion 402*a* of the eccentric portion 402 formed such that the outer diameter gradually decreases along the clockwise direction from the outer peripheral end of the abutting surface 401*a*, as a convex portion having a curved side surface projected outward along the radial direction.

In addition, the eccentric portion 402 of the eccentric cam member 400 is configured with a circular arc portion 402*b* formed in a circular arc shape across the central angle of substantially 180 degrees from the lower end portion of the abutting surface 401*a*, and a diameter expansion eccentric portion 402*a* that is eccentric such that the outer diameter gradually increases across the region from the circular arc portion 402*b* to the abutting surface 401*a* along the counterclockwise direction. Therefore, in the eccentric cam member 400, between the outer peripheral end of the abutting surface 401*a* of the abutting portion 401 and the circular arc portion 402*b*, the abutting portion 401 as a cutout portion configured with a stepped portion in which the outer diameter of the eccentric cam member 400 rapidly changes, is provided.

As illustrated in FIGS. 18A and 18B, the eccentric cam member 400 includes a torsion spring 411 as a resetting unit that resets the eccentric cam member 400 to an initial position by biasing the eccentric cam member 400 in the counterclockwise direction when the abutting surface 401*a* stops upward along the vertical direction and the end parts of the guide positioning portions 151 and 152 of the attachment housing 80 abut against the abutting surface 401*a* and rotate in the clockwise direction. The eccentric cam member 400 is provided with a locking groove 403 for locking an end part portion 411*a* of the torsion spring 411 at the lower end portion of the abutting surface 401*a*. In addition, a base end portion 411*b* of the torsion spring 411 is inserted into an insertion hole 412 provided in the inner frame 1*a*' of the apparatus main body 1*a*.

Operation of Image Forming Apparatus

In the color image forming apparatus 1, as illustrated in FIG. 4, in a case where a transport failure, such as so-called jamming of the recording paper 5, occurs at the secondary transfer position T2 or at the fixing device 40, or in a case where the secondary transfer roll 31 is exchanged, the side cover 110 provided on the side surface of the apparatus main body 1*a* is opened and closed.

As illustrated in FIG. 3, the user operates the operation portion (not illustrated) provided on the side cover 110, and releases the locked state between the columnar locking portion 113 provided on the apparatus main body 1*a* side and the locking member 114 provided on the side cover 110 side, and as illustrated in FIG. 4, the side cover 110 is rotated in the counterclockwise direction around the fulcrum 111. By doing this, the side cover 110 provided on the side surface of the apparatus main body 1*a* is opened. In a state where the side cover 110 is completely opened, the side cover 110 is stopped at the position where the side cover 110 is rotated in the counterclockwise direction only by the required angle.

At this time, as illustrated in FIGS. 3 and 4, the secondary transfer unit 300 of the color image forming apparatus 1 is exposed to the outside, and further the nipped (press-contact) state of the backup roll 25 that supports the secondary transfer roll 31 and the intermediate transfer belt 21 is released. Therefore, the user can easily remove the recording paper 5 in which the transport failure has occurred at the secondary transfer position T2 or the like. In addition, exchange work or the like of the secondary transfer roll 31 is performed by the user as necessary. As illustrated in FIGS. 5 and 13, the exchange of the secondary transfer roll 31 is performed by operating the first and second mounting portions 773, 783, 774, and 784 provided in the detachable members 77 and 78 of the holding member 70, and by detaching the secondary transfer roll 31 from the attachment housing 80 together with the holding member 70, in the secondary transfer unit 300.

Thereafter, when work, such as removal of the recording paper 5 in which the transport failure has occurred, or the exchange of the secondary transfer roll 31, is completed, the side cover 110 is closed by the user.

Figure 19:
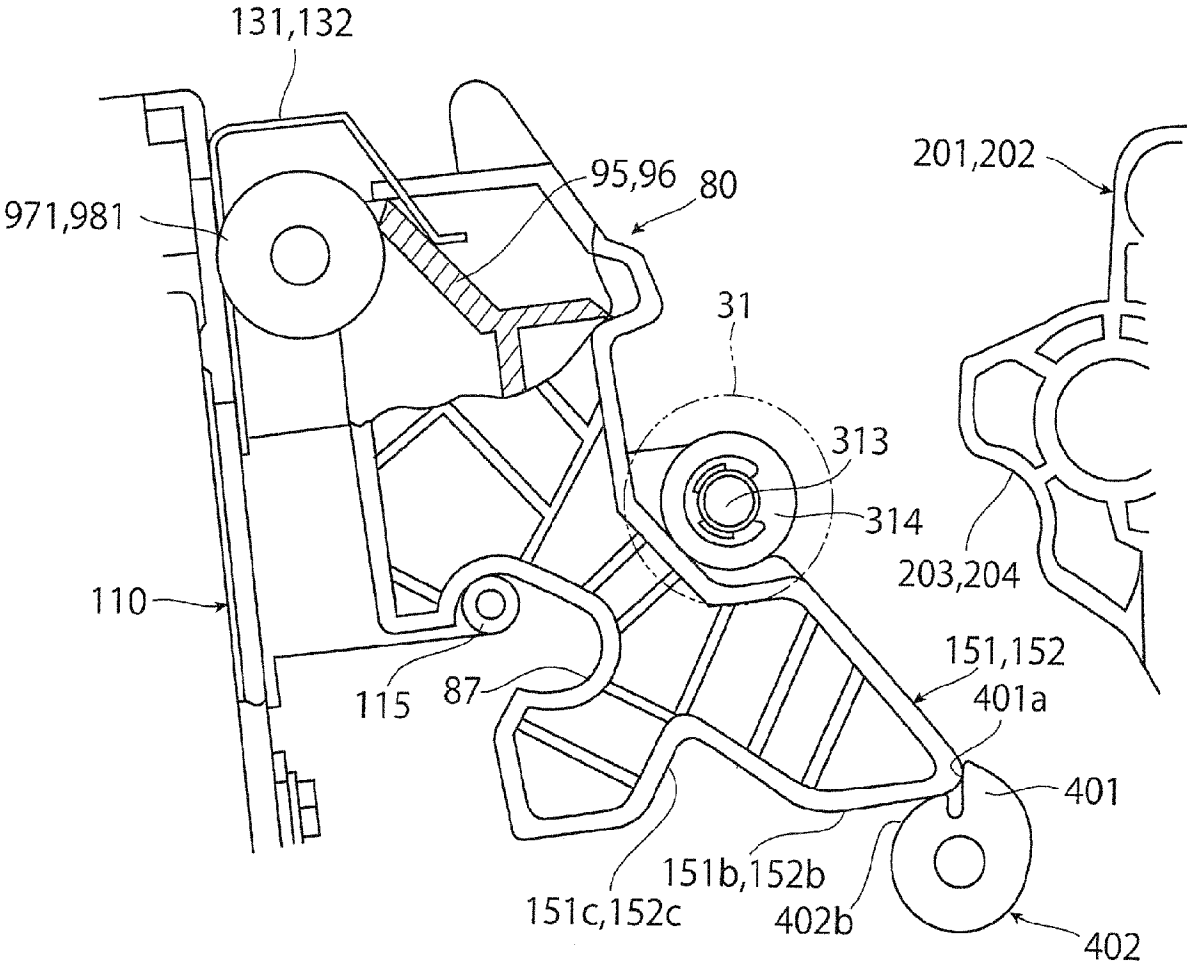
FIG. 19 is a schematic view illustrating an operation of a main part of a fixing device of the related art.

When the side cover 110 is rotated in the closing direction by the user, as illustrated in FIG. 16, the secondary transfer unit 300 rotates around the fulcrum 111 along the clockwise direction together with a side cover 1101. Then, in the secondary transfer unit 300, as illustrated in FIG. 19, the end parts of the guide positioning portions 151 and 152 of the attachment housing 80 come into contact with the eccentric cam member 400 provided on the apparatus main body 1*a*.

At this time, in the eccentric cam member 400, the abutting surface 401*a* of the abutting portion 401 and the circular arc portion 402*b* of the eccentric portion 402 stop at a position at which the end parts of the guide positioning portions 151 and 152 and the bottoms 151*b* and 152*b* of the attachment housing 80 come into contact with each other.

Figure 20:
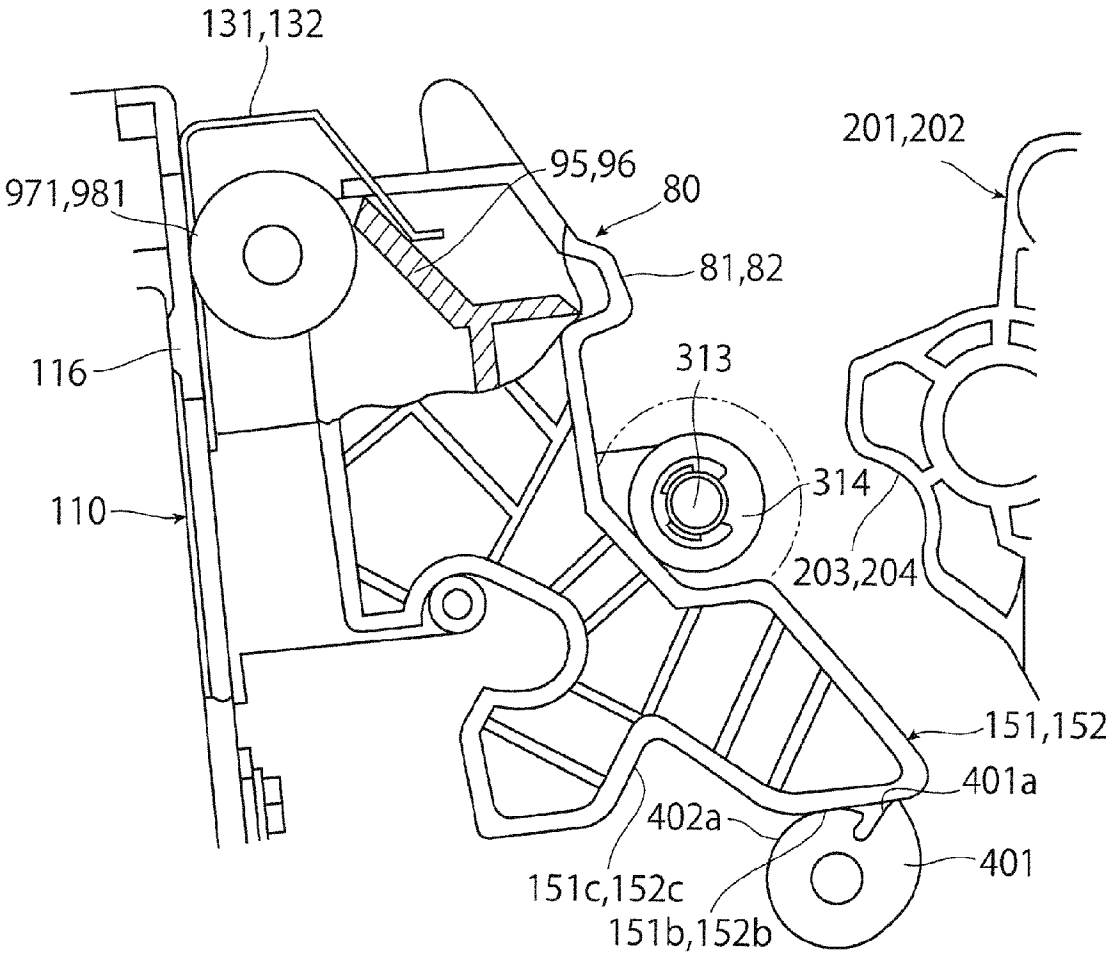
FIG. 20 is a schematic configuration diagram illustrating a main part of a fixing device according to Exemplary Embodiment 2 of the disclosure.

Next, when the side cover 110 is further rotated in the closing direction, in the eccentric cam member 400, as illustrated in FIG. 20, the abutting surface 401*a* of the abutting portion 401 rotates in the clockwise direction while being pressed by the end parts of the guide positioning portions 151 and 152 of the attachment housing 80.

Then, the attachment housing 80 attached to the side cover 110 is guided to the inside of the apparatus main body 1*a* by the eccentric cam member 400 in a state where the bottoms 151*b* and 152*b* are in contact with the upper end portion of the abutting surface 401*a* and the circular arc portion 402*b* of the eccentric cam member 400.

Figure 21:
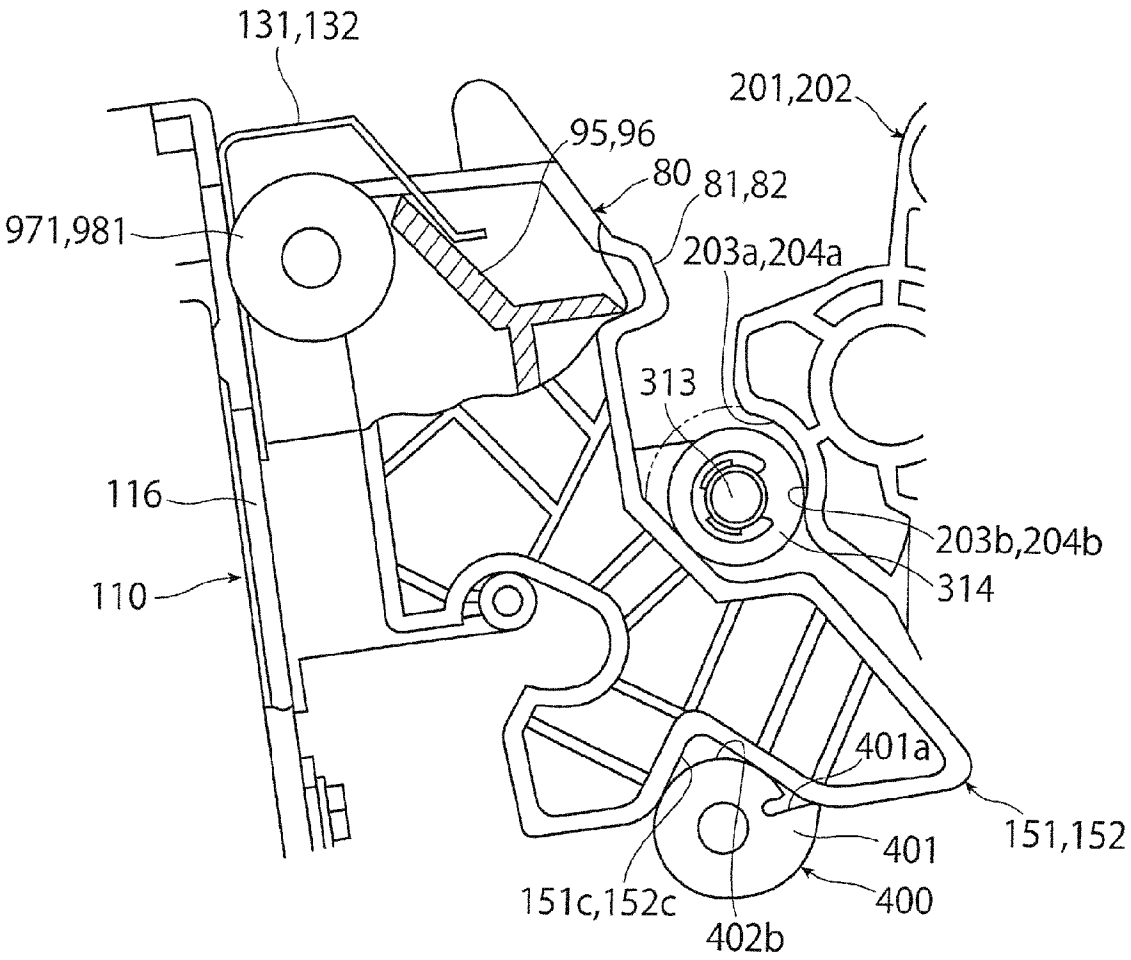
FIG. 21 is a sectional view illustrating a state in the middle of closing the side cover.

Thereafter, when the side cover 110 is further rotated in the closing direction, as illustrated in FIG. 21, the eccentric cam member 400 moves to the inside of the cutout portions 151*c* and 152*c* of the attachment housing 80, and the attachment housing 80 is displaced downward with respect to the side cover 110. At the same time, the bearing member 314 of the secondary transfer roll 31 attached to the attachment housing 80 abuts against the inner peripheral surfaces 203*b* and 204*b* of the lower portions of the positioning recessed portions 203 and 204 on the apparatus main body 1*a* side.

Figure 22:
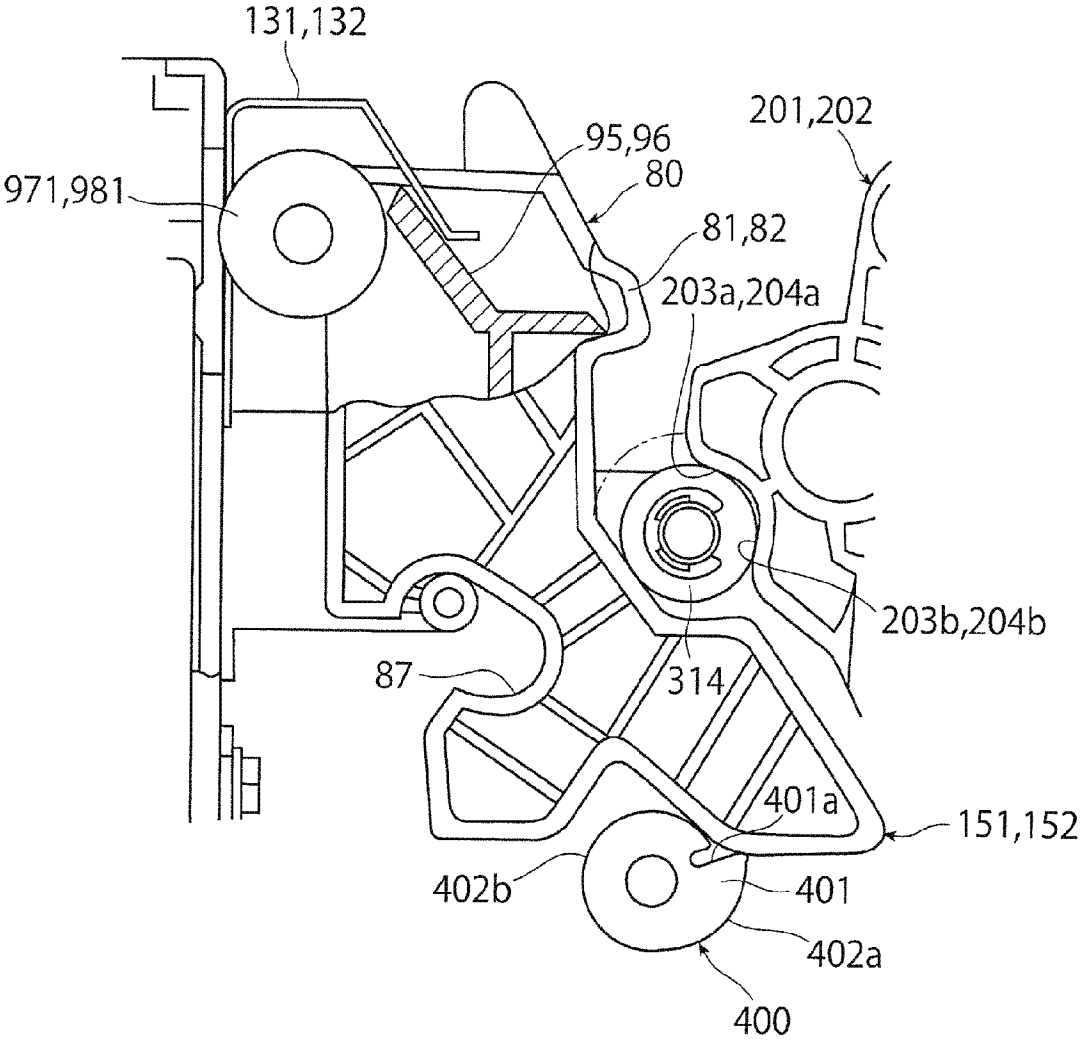
FIG. 22 is a sectional view illustrating a state in the middle of closing the side cover.

Furthermore, when the side cover 110 is further rotated in the closing direction, as illustrated in FIG. 22, the bearing member 314 of the secondary transfer roll 31 abuts against both the inner peripheral surfaces 203*b* and 204*b* of the lower portions and the upper portions 203*a* and 204*a* of the positioning recessed portions 203 and 204 on the apparatus main body 1*a* side, and the bearing member 314 of the secondary transfer roll 31 is positioned in the positioning recessed portions 203 and 204 on the apparatus main body 1*a* side. At this time, the side cover 110 is not completely closed yet.

Thereafter, when the side cover 110 is completely closed, as illustrated in FIG. 12, in the attachment housing 80, the bearing member 314 of the secondary transfer roll 31 is positioned on the inner peripheral surfaces 203*b* and 204*b* of the lower portions and the upper portions 203*a* and 204*a* of the positioning recessed portions 203 and 204 on the apparatus main body 1*a* side, the bottoms 151*b* and 152*b* and the cutout portions 151*c* and 152*c* of both side wall portions 81 and 82 of the attachment housing 80 come into contact with both the abutting surface 401*a* and the circular arc portion 402*b* of the eccentric cam member 400, and the secondary transfer roll 31 attached to the attachment housing 80 is fixed to the secondary transfer position T2 of the apparatus main body 1*a*.

At this time, in the attachment housing 80, the bottoms 151*b* and 152*b* and the cutout portions 151*c* and 152*c* of both side wall portions 81 and 82 are positioned by the eccentric cam member 400, and the inclined surfaces 912 and 922 of the fixing recesses 91 and 92 are fixed to the secondary transfer position T2 positioned in the positioning recessed portions 203 and 204 on the apparatus main body 1*a* side via the bearing member 314 of the secondary transfer roll 31.

At the same time, in the attachment housing 80, in a state where the position with respect to the apparatus main body 1*a* is fixed, the side cover 110 is finally completely closed. Therefore, there is no case where the attachment housing 80 moves from the position illustrated in FIG. 22 to a state where the side cover 110 illustrated in FIG. 12 is completely closed. Therefore, when the side cover 110 is completely closed, the first rollers 971 and 981 of the pressing mechanisms 97 and 98 provided in the side cover 110 rotate and move only by a required distance downward along the rear surfaces of both inclined plate portions 95 and 96 of the attachment housing 80. With the downward movement of the first rollers 971 and 981, the coil springs 975 and 985 of the pressing mechanisms 97 and 98 are correspondingly compressed. Therefore, the attachment housing 80 receives the pressing force upward from the first rollers 971 and 981 via both inclined plate portions 95 and 96 as a reaction force that corresponds to a compression amount of the coil springs 975 and 985 of the pressing mechanisms 97 and 98, and the bearing member 314 of the secondary transfer roll 31 is in press-contact with the positioning recessed portions 203 and 204 of the apparatus main body 1*a* using the pressing force as a preload. In addition, the elastic layer 312 of the secondary transfer roll 31 is in press-contact with the belt support roll 25 that functions as a backup roll via the intermediate transfer belt 21 to be elastically deformed.

The preload applied to the rear surfaces of both inclined plate portions 95 and 96 of the attachment housing 80 via the first rollers 971 and 981 is applied by an operation of rotating the side cover 110 in the closing direction around the fulcrum 111. As illustrated in FIG. 4, since the positions at which the first rollers 971 and 981 of the side cover 110 press against the attachment housing 80 are set at positions away from the fulcrum 111, even when the attachment housing 80 is preloaded by the first rollers 971 and 981, the operating force when closing the side cover 110 hardly increases.

As described above, in Exemplary Embodiment 1, as illustrated in FIGS. 18A and 18B, since the eccentric cam member 400 provided on the apparatus main body 1*a* side is provided with the cutout portion including the abutting surface 401*a* and the circular arc portion 402*b*, when closing the side cover 110, the end parts the guide positioning portions 151 and 152 of the attachment housing 80 abut against the abutting surface 401*a* of the eccentric cam member 400, the eccentric cam member 400 reliably rotates, and the guide positioning portions 151 and 152 of the attachment housing 80 are guided to an appropriate position.

Therefore, in the color image forming apparatus 1 according to Exemplary Embodiment 1, as illustrated in FIGS. 17A and 1713, due to the mounting error or the dimensional error of the side cover 110 or the mounting error or the dimensional error of the secondary transfer unit 300 or the eccentric cam member 400, when closing the side cover 110, the end parts of the guide positioning portions 151 and 152 of the attachment housing 80 interfere with the eccentric cam member 400, and there is no concern that the bearing member 314 of the secondary transfer roll 31 abuts against the part other than the positioning recessed portions 203 and 204 of the apparatus main body 1*a*. Accordingly, in the color image forming apparatus 1 according to Exemplary Embodiment 1, the hearing member 314 of the secondary transfer roll 31 can be reliably guided and positioned in the positioning recessed portions 203 and 204 of the apparatus main body 1*a*, which reduces or prevents an accident in which the bearing member 314 of the secondary transfer roll 31 butts against the parts other than the positioning recessed portions 203 and 204 of the apparatus main body 1*a* to increase the operation force for closing the side cover 110 or an accident in which the secondary transfer roll 31 cannot be positioned to the appropriate secondary transfer position T2 to cause a transfer failure or the like.

Exemplary Embodiment 2

Figure 23:
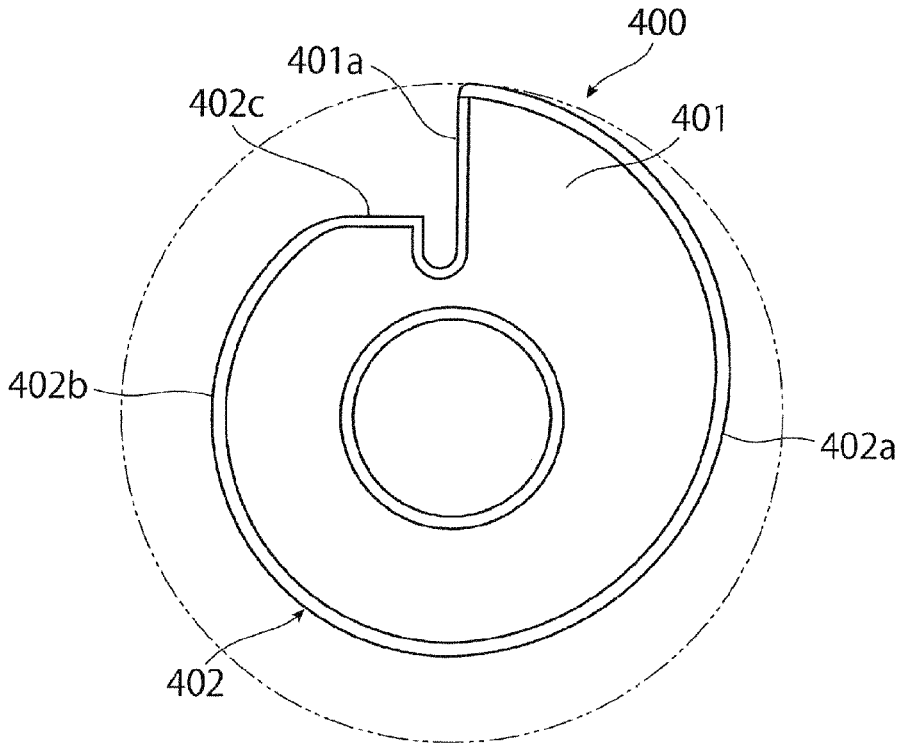
FIG. 23 is a side configuration view illustrating a rotating unit of an image forming apparatus according to Exemplary Embodiment 2 of the disclosure.

FIG. 23 is a configuration view illustrating a main part of an image forming apparatus according to Exemplary Embodiment 2 of the disclosure.

In other words, in Exemplary Embodiment 2, as illustrated in FIG. 23, the end portion 402*c* on the abutting surface 401*a* side of the circular arc portion 402*b* that configures the cutout portion of the eccentric cam member 400 is not in a circular arc shape, but is formed in a curved shape or a flat shape having an outer diameter smaller than that of the circular arc portion 402*b*, and the cutout region of the end portion 402*c* on the abutting surface 401*a* side is greater than that of Exemplary Embodiment 1.

Therefore, in Exemplary Embodiment 2, compared to Exemplary Embodiment 1, when the end parts of the guide positioning portions 151 and 152 of the attachment housing 80 abut against the abutting surface 401*a* of the eccentric cam member 400, it is possible to further avoid or prevent the interference between the end parts of the guide positioning portions 151 and 152 of the attachment housing 80 and the eccentric cam member 400, and it becomes possible to more reliably guide the guide positioning portions 151 and 152 of the attachment housing 80.

Since the other configurations and operations are the same as those of Exemplary Embodiment 1, the description thereof will be omitted.

Exemplary Embodiment 3

Figure 24:
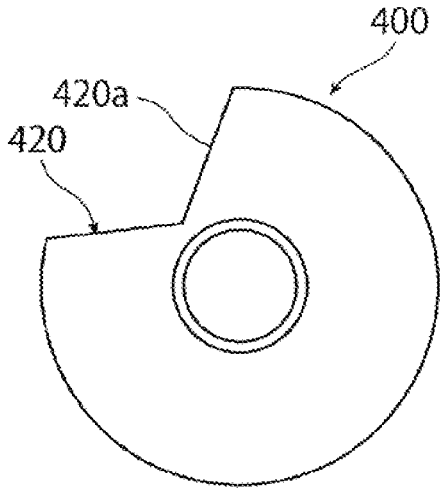
FIG. 24 is a side configuration view illustrating a rotating unit of an image forming apparatus according to Exemplary Embodiment 3 of the disclosure.

FIG. 24 is a configuration view illustrating a main part of an image forming apparatus according to Exemplary Embodiment 3 of the disclosure.

In other words, in Exemplary Embodiment 3, as illustrated in FIG. 24, instead of providing the eccentric portion 402 on the eccentric cam member 400, the eccentric cam member 400 is formed in a columnar shape or cylindrical shape having a constant outer diameter, and a cutout portion 420 cut in a shape having a substantially V-shaped side surface is provided on the outer periphery of the eccentric cam member 400.

In Exemplary Embodiment 3, when the end parts of the guide positioning portions 151 and 152 of the attachment housing. 80 abut against the eccentric cam member 400, the end parts of the guide positioning portions 151 and 152 of the attachment housing 80 can reliably abut against the end surface 420*a* of the cutout portion 420 of the eccentric cam member 400 and rotate, and it becomes possible to reliably guide the guide positioning portions 151 and 152 of the attachment housing 80.

Since the other configurations and operations are the same as those of Exemplary Embodiment 1, the description thereof will be omitted.

In addition, in the Exemplary Embodiments described above, the color image forming apparatus provided with four imaging devices 10Y, 10M, 10C, and 10BK of yellow (Y), magenta (M), cyan (C), and black (BK) are described, but the disclosure is not limited thereto, and as an image forming apparatus, it is needless to say that the same is also applied to a monochrome image forming apparatus provided only with the imaging device of black (BK). In this case, the primary transfer device for transferring an image from the imaging device of black (BK) to a recording medium is used as the transfer unit.

In addition, in Exemplary Embodiments described above, a case where the side cover is applied as the opening and closing unit has been described, but the disclosure is not limited thereto, and it is needless to say that any front cover or rear cover is applied as the opening and closing unit as long as the transfer unit can be mounted thereon.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an cover that is openable and closable with respect to an apparatus main body;

a transfer roller that is provided in the apparatus main body and configured to transfer an image from a transfer belt to a recording medium at a transfer position;

a housing configured to attach the transfer roller to the cover so as to be movable between the transfer position and a temporary holding position when the cover is opened and closed; and an eccentric cam that is provided in the apparatus main body, has a cutout portion configured to rotate while being in contact with the housing when the cover is closed, and configured to move the transfer roller toward the transfer position.

2. The image forming apparatus according to claim 1, wherein the eccentric cam comprises:

an abutting portion abutting against the housing to rotate the eccentric cam; and an eccentric portion that is so eccentric as to have a gradually increasing outer diameter.

3. The image forming apparatus according to claim 2, wherein the eccentric cam is biased by a biasing member in a direction opposite to a rotating direction when being in contact with the housing.

4. The image forming apparatus according to claim 1, wherein the housing comprises a pair of support members that respectively supports, in a rotatable state, both end portions of the transfer roller along an axial direction of the transfer roller, and the pair of support members is attached to the cover so as to be movable between the transfer position and the temporary holding position, via a long hole into which a support shaft provided in the housing is inserted through a gap and via a regulation portion whose location is regulated when abutting against a butting member provided in the housing.

5. The image forming apparatus according to claim 4, wherein the long hole is provided such that an end portion on the cover along a long radial direction is positioned above in a vertical direction.

6. The image forming apparatus according to 1, wherein the cover has a rotation biasing unit that is movable by rotation along a substrate of the cover and that biases the housing toward the apparatus main body.

7. The image forming apparatus according to claim 6, wherein the rotation biasing unit comprises:

a first roller configured to rotate along an inclined surface provided on the housing so as to be inclined with respect to the substrate of the cover;

a second roller that is disposed coaxially with the first roller, comprising an outer diameter smaller than that of the first roller, and configured to rotate along the substrate of the cover; and a biasing member configured to bias the first and second rollers so as to press the first and second rollers against the inclined surface of the housing and the substrate of the cover.

8. The image forming apparatus according to claim 1, wherein:

the housing comprises positioning members respectively provided at both end portions of the transfer roller along an axial direction of the transfer roller, and configured to position the transfer roller at the transfer position of the apparatus main body, and the apparatus main body comprises a positioning portion being in contact with the positioning member, the positioning portion configured to position the transfer roller at the transfer position.

9. The image forming apparatus according to claim 8, wherein:

the positioning member comprises a bearing member rotatably supporting the transfer roller, and the positioning portion is a recessed portion having a V-shaped section that is open with respect to a direction intersecting a tangent of a surface of the transfer belt at the transfer position.

10. The image forming apparatus according to claim 9, wherein when the cover is closed, the positioning member is configured to come into contact with a first side surface positioned on a lower side along a vertical direction in the recessed portion having the V-shaped section, and then comes into contact with a second side surface positioned on the lower side along the vertical direction.

11. The image forming apparatus according to claim 9, wherein wherein:

the cover comprises a rotation biasing unit being movable by rotation along a substrate of the cover, the rotation biasing unit configured to bias the housing toward the apparatus main body, the rotation biasing unit comprises:

a first roller configured to rotate along an inclined surface provided on the housing so as to be inclined with respect to the substrate of the cover;

a second roller being disposed coaxially with the first roller, comprising an outer diameter smaller than that of the first roller, and configured to rotate along the substrate of the cover, and a biasing member that biases the first and second rollers so as to press the rollers against the inclined surface of the housing and the substrate of the cover, and the rotation biasing unit is configured such that when the cover is closed so that the positioning member is positioned at the recessed portion, the first and second rollers move in a direction to compress a pressing member and such that a preload that presses the positioning member against the recessed portion is applied by a pressing force generated when the first and second rollers move in the direction to compress the pressing member.

12. The image forming apparatus according to claim 1, wherein the eccentric cam is configured to move the transfer roller toward the transfer position by moving the housing toward the apparatus main body based on rotation of the eccentric cam.

* * * * *